US006089171A

United States Patent [19]

Fong et al.

[11] Patent Number: 6,089,171

[45] Date of Patent: Jul. 18, 2000

[54] MINIMUM RECIRCULATION FLAME CONTROL (MRFC) PULVERIZED SOLID FUEL NOZZLE TIP

[75] Inventors: Milton A. Fong, South Windsor, Conn.; Todd D. Hellewell, Windsor, Conn.; Robert D. Lewis, Cromwell, Conn.; Charles Q. Maney, Longmeadow; Srivats Srinivasachar, Sturbridge, both of Mass.; Majed A. Toqan, Avon; David P. Towle, Simsbury, both of Conn.

[73] Assignee: Combustion Engineering, Inc., Windsor, Conn.

[21] Appl. No.: 08/912,903

[22] Filed: Aug. 15, 1997

Related U.S. Application Data

[63] Continuation-in-part of application No. 08/676,772, Jul. 8, 1996.

[51] Int. Cl.[7] ..... F23D 1/00

[52] U.S. Cl. ..... 110/263; 110/104 B; 110/347; 110/261; 239/423; 239/498; 239/518; 239/587.4; 239/587.5; 431/8

[58] Field of Search ..... 110/104 B, 260, 110/261, 262, 263, 264, 265, 347; 431/8, 173, 181, 187, 189; 239/423, 424, 424.5, 498, 587.5, 587.4, 419.5, 590.5, 518, 290, 299

[56] References Cited

U.S. PATENT DOCUMENTS

| | | | |
|---|---|---|---|
| Re. 16,984 | 6/1928 | Leach | 110/263 |
| 1,457,522 | 6/1923 | Grindle | 110/104 B |
| 2,895,435 | 7/1959 | Bogot et al. . | |
| 3,589,315 | 9/1969 | Hart | 110/265 |
| 4,274,343 | 6/1981 | Kokkinos | 110/263 |
| 4,356,975 | 11/1982 | Chadshay | 239/419.5 |
| 4,434,727 | 3/1984 | McCartney | 110/347 |
| 4,520,739 | 6/1985 | McCartney et al. | 110/263 |
| 4,539,918 | 9/1985 | Beer et al. | 110/265 X |
| 4,572,084 | 2/1986 | Green et al. | 110/261 |
| 4,634,054 | 1/1987 | Grusha . | |
| 4,719,587 | 1/1988 | Berte . | |
| 5,215,259 | 6/1993 | Wark | 110/263 X |
| 5,240,409 | 8/1993 | Xiong | 431/189 |
| 5,315,939 | 5/1994 | Rini et al. | 110/264 |
| 5,529,000 | 6/1996 | Hartel et al. | 110/261 X |
| 5,662,464 | 9/1997 | LaRose et al. | 431/8 |
| 5,762,007 | 6/1998 | Vatsky | 110/264 |

FOREIGN PATENT DOCUMENTS

| | | | |
|---|---|---|---|
| 547338 | 3/1932 | Germany | 110/263 |
| 310555 | 5/1929 | United Kingdom | 110/263 |

OTHER PUBLICATIONS

Webster's II New Riverside University Dictionary, The Riverside Publishing Company, p. 1080, 1994.

*Primary Examiner*—Ljiljana V. Ciric
*Attorney, Agent, or Firm*—Arthur E. Fournier, Jr.

[57] ABSTRACT

A minimum recirculation flame control (MRFC) solid fuel nozzle tip (12) that is suited to being cooperatively associated with a pulverized solid fuel nozzle (34) of a firing system in a pulverized solid fuel-fired furnace (10). The MRFC solid fuel nozzle tip (12) includes a secondary air shroud (46), secondary air shroud support (50) operative for supporting the primary air shroud (48) relative to the secondary air shroud (46), and a splitter plate (52) mounted in supported relation within the primary air shroud (48).

17 Claims, 7 Drawing Sheets

MINIMUM RECIRCULATION FLAME CONTROL (MRFC) PULVERIZED SOLID FUEL NOZZLE TIP

This is a continuation-in-part of application Ser. No. 08/676,772 filed Jul. 8, 1996.

BACKGROUND OF THE INVENTION

This invention relates to firing systems for use with pulverized solid fuel-fired furnaces, and more specifically, to a minimum recirculation flame control (MRFC) solid fuel nozzle tip for use in such firing systems.

It has long been known in the prior art to employ pulverized solid fuel nozzle tips in firing systems of the type that are utilized in pulverized solid fuel-fired furnaces. By way of exemplification and not limitation in this regard, reference may be had to U.S. Pat. No. 2,895,435 entitled "Tilting Nozzle For Fuel Burner", which issued on Jul. 21, 1959 and which was assigned to the same assignee as the present patent application. In accordance with the teachings of U.S. Pat. No. 2,895,435, there is provided a tilting nozzle that is alleged to provide substantially uniform distribution of the secondary air mixture leaving the tilting nozzle and substantially uniform velocity across the discharge opening of the tilting nozzle into the furnace. To this end, the tilting nozzle includes an inner conduit 5 within an outer conduit 6. Moreover, a plurality of baffles or division walls 17, 18 and 19 are provided within the inner conduit 5 arranged in planes substantially parallel to fluid flow and such as to divide the inner conduit 5 into a multiplicity of parallel channels. These baffles or division walls 17, 18 and 19 are designed to be operative to correct the concentration of the air-fuel mixture along the deflecting wall of the inner conduit 5 and the resulting relatively unequal pressure there when the titling nozzle is tilted. Thus, the effect is that as the tilting nozzle is tilted, either upwardly or downwardly, the unequal velocities through the tilting nozzle are made substantially equal by restricting the flow in the high pressure zone present at the inlet end of the inner conduit 5 and encouraging the flow in the low pressure zone also present at the inlet end of the inner conduit 5.

Another prior art form of a pulverized solid fuel nozzle tip that has been employed in firing systems of the type that are utilized in pulverized solid fuel-fired furnaces is depicted in U.S. Pat. No. 4,274,343 entitled "Low Load Coal Nozzle", which issued on Jun. 23, 1981 and which is assigned to the same assignee as the present patent application. In accordance with the teachings of U.S. Pat. No. 4,274,343, there is provided a fuel-fired admission assembly of the type incorporating a split coal bucket having an upper and a lower coal nozzle pivotally mounted to the coal delivery pipe and independently tiltable of each other. Continuing, a plate is disposed along the longitudinal axis of the coal delivery pipe with its leading edge oriented across the inlet end of the coal delivery pipe so that that portion of the primary air pulverized coal stream having a high coal concentration enters the coal delivery pipe on one side of the plate and that portion of the primary air-pulverized coal stream having a low coal concentration enters the coal delivery pipe on one side of the plate and that portion of the primary air-pulverized coal stream having a low coal concentration enters the coal delivery pipe on the other side of the plate. Moreover, the trailing edge of the plate is orientated across the outlet end of the coal delivery pipe such that that portion of the primary air-pulverized coal stream having a high coal concentration is discharged from the coal delivery pipe through the upper coal nozzle and such that that portion of the primary air-pulverized coal stream having a low coal concentration is discharged from the coal delivery pipe through the lower coal nozzle.

Still another prior art form of a pulverized solid fuel nozzle tip that has been employed in firing systems of the type that are utilized in pulverized solid fuel-fired furnaces is depicted in U.S. Pat. No. 4,356,975 entitled "Nozzle Tip For Pulverized Coal Burner", which issued on Nov. 2, 1982 and which is assigned to the same assignee as the present patent application. In accordance with the teachings of U.S. Pat. No. 4,356,975, there is provided a nozzle tip having one or more splitter plates disposed therein, which is characterized in that the splitter plates comprise a first plate of highly abrasion resistant material disposed at the inlet end of the nozzle tip and a second plate of highly heat resistant material disposed at the outlet end of the nozzle tip. Furthermore, the first plate of highly abrasion resistant material has its leading edge, which is preferably rounded, disposed along the inlet end of the nozzle tip and extends a substantial distance through the inner shell of the nozzle tip along a line parallel to the longitudinal axis thereof. Also, the highly abrasion resistant plate terminates within the nozzle tip with its trailing edge set back from the discharge end of the nozzle tip. Moreover, the second plate of highly heat resistant material is disposed within the inner shell so as to abut the trailing edge of the highly abrasion resistant plate and extends therefrom towards the discharge end of the nozzle tip along a line parallel to the longitudinal axis thereof.

Still a further prior art form of a pulverized solid fuel nozzle tip that has been employed in firing systems of the type that are utilized in pulverized solid fuel-fired furnaces is to be found depicted in U.S. Pat. No. 4,434,727 entitled "Method For Low Load Operation Of A Coal-Fired Furnace", which issued on Mar. 6, 1984 and which is assigned to the same assignee as the present patent application. In accordance with the teachings of U.S. Pat. No. 4,434,727, there is provided a fuel-air admission assembly whereby the primary air and pulverized coal mixture discharging into the furnace is split into two independent coal-air streams when the furnace is operated at low loads such as during the minimum demand periods. Furthermore, the split primary air and pulverized coal streams are independently directed into the furnace in angular relationship away from each other. Thus, in doing so an ignition stabilizing pocket is established in the locally low pressure zone created between the spread apart coal-air streams. Accordingly, hot combustion products are drawn, i.e., recirculated, into this low pressure zone, thereby providing enough additional ignition energy to the incoming fuel to stabilize the flame.

Yet another prior art form of a pulverized solid fuel nozzle tip that has been employed in firing systems of the type that are utilized in pulverized solid fuel-fired furnaces is depicted in U.S. Pat. No. 4,520,739 entitled "Nozzle Tip For Pulverized Coal Burner", which issued on Jun. 4, 1985 and which is assigned to the same assignee as the present patent application. In accordance with the teachings of U.S. Pat. No. 4,520,739, there is provided a nozzle tip for a burner on a pulverized coal-fired furnace for receiving a stream of pulverized coal and air discharging from the coal delivery pipe of the burner and directing the pulverized fuel and air stream into the furnace. This nozzle tip is comprised of a base body, a replaceable highly abrasion resistant insert, and a replaceable highly temperature resistant end cap that is readily attachable by mechanical means to the base body with the abrasion resistant insert disposed therein.

Moreover, the insert defines a highly abrasion resistant flow conduit through the nozzle tip from the discharge end of the base body to the receiving end of the end cap through which the pulverized fuel and air stream passes from the burner into the furnace.

Yet still another prior art form of a pulverized solid fuel nozzle tip that has been employed in firing systems of the type that are utilized in pulverized solid fuel-fired furnaces is depicted in U.S. Pat. No. 4,634,054 entitled "Split Nozzle Tip For Pulverized Coal Burner", which issued on Jan. 6, 1987 and which is assigned to the same assignee as the present patent application. In accordance with the teachings of U.S. Pat. No. 4,634,054, there is provided a nozzle tip for a burner on a pulverized fuel-fired furnace that is alleged to be particularly adapted to provide improved ignition stability during low load operation of the furnace. This nozzle tip comprises an open-ended inner shell defining a flow passageway through which a mixture of pulverized fuel and transport air passes from the burner into the furnace, an open-ended outer shell spaced from and surrounding the inner shell thereby defining an annular flow passage therebetween through which additional air for combustion passes from the burner into the furnace and plate means disposed within the inner shell for dividing the flow passageway therethrough into first and second flow passages that extend from the inlet of the inner shell to the outlet of the inner shell in a diverging manner with a void region established therebetween through which flow is precluded. By virtue of the construction thereof, the coal-air mixture discharging from the burner is split by the plate means into a first stream that is directed into the furnace through the first flow passageway through the inner shell and a second stream that is directed into the furnace through the second flow passageway of the inner shell. Thus, the coal-air mixture is directed into the furnace in two diverging streams. As such, in doing so an ignition stabilizing pocket is established in the locally low pressure zone created between the spread-apart and diverging coal-air streams in the furnace just downstream of the void region established between the diverging first and second flow passageways through the inner shell of the nozzle tip. Accordingly, coal is concentrated in this pocket and hot combustion products are drawn back into the pocket from the flame to provide additional ignition energy to the incoming fuel to stabilize the flame.

Yet a further prior art form of a pulverized solid fuel nozzle tip that has been employed in firing systems of the type that are utilized in pulverized solid fuel-fired furnaces is depicted in U.S. Pat. No. 5,315,939 entitled "Integrated Low $NO_X$ Tangential Firing System", which issued on May 31, 1994 and which is assigned to the same assignee as the present patent application. In accordance with the teachings of U.S. Pat. No. 5,315,939, there is provided a fuel nozzle that embodies a flame attachment pulverized solid fuel nozzle tip. The principal function of this flame attachment pulverized solid fuel nozzle tip is stated to be that of effecting the ignition of the pulverized solid fuel being injected therefrom into the burner region of the pulverized solid fuel-fired furnace at a point in closer proximity, i.e., within two feet thereof, than that at which it has been possible to effect ignition heretofore with prior art forms of pulverized solid fuel nozzle tips. Moreover, this flame attachment pulverized solid fuel nozzle tip is characterized principally by the bluff-body lattice structure, which is provided at the discharge end thereof. This lattice structure is said to change the characteristics of the pulverized solid secondary air stream, which is being discharged from the flame attachment pulverized solid fuel nozzle tip, from principally laminar flow to turbulent flow. The increased turbulence in the pulverized solid fuel/air stream increases the dynamic flame propagation speed and combustion intensity. This in turn results in rapid ignition of the entire pulverized solid fuel/air jet (close to the flame attachment pulverized solid fuel nozzle tip but not attached thereto), high early flame temperature (maximize volatile matter release including fuel nitrogen) and rapid consumption of available oxygen (minimize early NO formation). The real benefit and commercial significance of the flame attachment pulverized solid fuel nozzle is stated to reside in its ability to provide excellent performance without having an attached flame. It is further stated that experience has shown that prior art forms of flame attachment nozzle tips can suffer premature failure and/or pluggage problems when firing certain pulverized solid fuels. To this end, since this flame attachment pulverized solid fuel nozzle tip can maintain a stable detached flame, it is said to be capable of obviating the pluggage/rapid burn-up problems, which have served to disadvantageously characterize the prior art forms of flame attachment nozzle tips that have been employed heretofore.

Although the pulverized solid fuel nozzle tips that form the subject matter of the issued U.S. patents to which reference has been had hereinbefore have been demonstrated to be operative for their intended purposes, there has nevertheless been evidenced in the prior art a need for such pulverized solid fuel nozzle tips to be further improved. In this regard, it has been found that pulverized solid fuel deposits, i.e., coal deposits, on and within the pulverized solid fuel, i.e., coal, nozzle tips are problematic from an operational standpoint. That is, such coal deposits on and within the coal nozzle tip have been found to lead to either premature or catastrophic coal nozzle tip failure, depending primarily upon the tenacity of the formed deposits and the rate at which the deposition occurs. To this end, deposition of coal on or within the coal nozzle tip is believed to be caused by a combination of the following three variables: 1) coal composition/type, i.e., slagging, non-slagging, sulfur/iron content, plasticity, etc.; 2) furnace/coal nozzle operational settings, i.e., primary/secondary air flow rate/velocity, tilt position, firing rate, etc.; and 3) coal nozzle tip aerodynamics.

Thus, by way of summary, present designs, i.e., prior art forms, of coal nozzle tips have by and large been found to exacerbate the coal deposition problem through the creation of regions of low or negative velocities, i.e., recirculation, that cause slowly moving, "hot", coal particles to come in contact with "hot" coal nozzle tip metal surface. Namely, it has been found that as a result of this interaction, and under requisite thermal conditions that are related to the coal's plasticity, some of the coal particulate sticks to the plate, thus initiating the deposition process. Moreover, with specific reference to present designs, i.e., prior art forms, of coal nozzle tips, it has been found that regions of low and negative velocities typically occur along the thickness of the nozzle plane platework and in the sharp corners of the primary air shroud.

There has, therefrom, been evidenced in the prior art a need for a new and improved pulverized solid fuel nozzle tip that would address the deficiencies from which present designs, i.e., prior art forms of pulverized solid fuel nozzle tips have been found to suffer. Namely, there has been evidenced in the prior art a need for a new and improved pulverized solid fuel nozzle tip that would be advantageously characterized in the following respects: 1) would minimize low and negative, i.e., recirculation, velocity regions at the exit plane of the pulverized solid fuel nozzle tip, 2) would reduce available deposition surface on the pulverized solid fuel nozzle tip, and 3) would vary the nozzle tip/solid fuel nozzle thermal conditions to keep the "hot" solid fuel particulate matter from deposition on available metal platework surfaces of the pulverized solid fuel nozzle tip. Such a new and improved pulverized solid fuel nozzle tip accordingly would be effective in controlling the deposition phenomena, from which present designs, i.e., prior art forms, of pulverized solid fuel nozzle tips have been found to suffer. This would be accomplished through the aerodynamic design embodied by such a new and improved pulverized solid fuel nozzle tip coupled with proper adjustment of the controllable operational variables, i.e., secondary air flow rate, etc. As employed herein, the term "controllable" refers to the fact that solid fuel type and furnace load, and in some, notably retrofit, cases primary air flow rate are typically not controllable operational variables for mitigation of the deposition phenomena.

To this end, such a new and improved pulverized solid fuel nozzle tip would be advantageously characterized by the fact that certain features were collectively embodied thereby. A first such feature is that the primary air shroud would be recessed. Recessing the primary air platework, i.e., primary air shroud, to within the exit plane of the secondary air shroud would remove this potential deposition surface from the firing zone, i.e., the exit plane of the nozzle tip, and would provide some cooling via the shielding effect of the secondary air shroud. Additionally, a shorter primary air plate, i.e., primary air shroud, would reduce the contact surface for heat transfer thereto and deposition thereon of coal particles. A second such feature is that the splitter plates would be recessed. Recessing the splitter plates along with the primary air shroud to within the exit plane of the secondary air shroud would remove this potential deposition surface from the firing zone, i.e., the exit plane of the nozzle tip, and would provide some cooling via the shielding effect of the secondary air shroud. Additionally, shorter splitter plates would reduce the contact surface for heat transfer thereto and deposition thereon of coal particles. A third such feature is that the secondary air shroud support ribs would be recessed. Recessing the secondary air shroud support ribs would keep the circulation region, and vertical deposition surface normally created by these devices at the exit of the nozzle tip from the firing zone, thus reducing their possible influence in the deposition process. Structurally, recessing the secondary air support ribs would also allow the front portions of the secondary air and primary air shrouds to independently expand reducing thermally induced stress. A fourth such feature is that the trailing edge of the primary air shroud would be tapered. Tapering the trailing edge of the primary air shroud would reduce the recirculation region created by the blunt faced trailing edge of present designs, i.e., prior art forms, of pulverized solid fuel nozzle tips. Such a recirculation region draws hot particulate matter back to the vertical plate surface creating or exacerbating the coal deposition phenomena. Also, such a recirculation region can provide conditions conducive to combustion, thus creating flames within the recirculation region, which raise temperatures and further exacerbate the deposition problem.

To this end, the primary air shroud platework would be tapered at a small enough angle such that neither the secondary air nor the primary air flows separate from the plate thus obviating the creation of additional, unwanted recirculation. A fifth such feature is that the splitter plate ends would be tapered. The splitter plate ends would be tapered to reduce the recirculation region created by the blunt faced trailing edge of present designs, i.e., prior art forms, of pulverized solid fuel nozzle tips, and the shed vortices created by the blunt faced leading edge of present designs, i.e., prior art forms, of pulverized solid fuel nozzle tips. As in the case of the blunt faced trailing edge of present designs, i.e., prior art forms, of pulverized solid fuel nozzle tips, the recirculation region induced by the blunt faced splitter plate of present designs, i.e., prior art forms, of pulverized solid fuel nozzle tips draws hot particulate back to the vertical plate surface creating or exacerbating the coal deposition phenomena. Also, such a recirculation region can provide conditions conducive to combustion, thus creating flames within the recirculation region, which raise temperatures and further exacerbate the deposition problem. In addition, the vortices induced by the blunt faced leading edge of present designs, i.e., prior art forms, of pulverized solid fuel nozzle tips increase turbulence levels within the primary stream thus exacerbating coal particulate deposition. To this end, the splitter plate edges would be tapered at a small enough angle to avoid primary air separation, which would create additional, unwanted flow recirculation. A sixth such feature is that the secondary air shroud would embody a bulbous inlet. The bulbous inlet of the secondary air shroud would minimize secondary air bypass of the fuel air shroud during tilt conditions which currently occurs with present designs, i.e., prior art forms, of pulverized solid fuel nozzle tips. Moreover, the bulbous inlet would enhance secondary air flow through the fuel air shroud thereby acting to both cool the nozzle tip platework, and thermally blanket the primary air/coal stream to delay ignition, which also provides a tip cooling effect. On the other hand, were the secondary air shroud flow to be allowed to drop severely due to tip bypass, low pressure/velocity regions could be created within the secondary air shroud, leading to reverse flow and particle deposition within this annular region. A seventh such feature is that the primary air shroud exit plane corners would be rounded. Rounding the primary air shroud exit plane corners increases the corner velocities with respect to that found in the ninety degree corners of present designs, i.e., prior art forms, of pulverized solid fuel nozzle tips. Increasing the corner velocities increases the erosion energy for air/coal flowing through this region to help remove active deposits, and otherwise avoid deposition. Also, the rounded corners decrease the available surface for heat transfer from the hot platework to the cooler air/coal mixture for a volume element of air/coal within the tip corner. An eighth such feature is that the secondary air shroud exit plane corners would be rounded. The rounded secondary air shroud exit plane corners, combined with the rounded primary air shroud exit plane corners, provide for higher corner velocities, thus minimizing low velocity regions on the secondary air shroud. In addition, the rounded secondary air shroud exit plane corners assist in achieving a uniform secondary air opening. A ninth such feature is that a uniform secondary air shroud opening (exit plane) would be provided. Providing a uniform secondary air shroud opening provides for uniform secondary air distribution within the nozzle tip. Namely, providing a uniform secondary air shroud opening provides for uniform nozzle tip cooling via the secondary air stream, but also provides for uniform blanketing of the primary air stream for control of ignition position and of $NO_X$ emissions. A tenth such feature is that for certain applications wherein minimum $NO_X$ emissions and/or minimum carbon in the flyash are criteria that need to be met, it would be possible to provide a version of such a new and improved pulverized solid fuel nozzle tip embodying collectively all of the nine features that have been enumerated hereinabove, which would enable minimum $NO_X$ emissions and/or minimum carbon in the flyash to be realized, while yet thereby enabling there to be realized concomitantly therewith minimum fuel deposition and therethrough avoidance of pulverized solid fuel nozzle tip failure occasioned thereby. Moreover, such minimization of $NO_X$ emissions and/or minimization of carbon in the flyash would be attainable by providing a version of such a new and improved pulverized solid fuel nozzle tip wherein one or more bluff bodies, each embodying a predefined geometry, are suitably supported in mounted relation at a predetermined location therewithin.

It is, therefore, an object of the present invention to provide a new and improved solid fuel nozzle tip for use in a firing system of the type utilized in pulverized solid fuel-fired furnaces.

It is a further object of the present invention to provide such a new and improved solid fuel nozzle tip for use in a firing system of the type utilized in a pulverized solid fuel-fired furnace that is operative as a minimum recirculation flame control (MRFC) solid fuel nozzle tip.

It is another object of the present invention to provide such a new and improved MRFC solid fuel nozzle tip for use in a firing system of the type utilized in a pulverized solid fuel-fired furnace that is characterized in that the primary air shroud thereof is recessed.

It is still another object of the present invention to provide such a new and improved MRFC solid fuel nozzle tip for use in a firing system of the type utilized in a pulverized solid fuel-fired furnace that is characterized in that the splitter plates thereof are recessed.

Another object of the present invention is to provide such a new and improved MRFC solid fuel nozzle tip for use in a firing system of the type utilized in a pulverized solid fuel-fired furnace that is characterized in that the secondary air shroud support ribs thereof are recessed.

A still another object of the present invention is to provide such a new and improved MRFC solid fuel nozzle tip for use in a firing system of the type utilized in a pulverized solid fuel-fired furnace that is characterized in that the trailing edge of the primary air shroud thereof is tapered.

A further object of the present invention is to provide such a new and improved MRFC solid fuel nozzle tip for use in a firing system of the type utilized in a pulverized solid fuel-fired furnace that is characterized in that the ends of the splitter plates thereof are tapered.

A still further object of the present invention is to provide such a new and improved MRFC solid fuel nozzle tip for use in a firing system of the type utilized in a pulverized solid fuel-fired furnace that is characterized in that the secondary air shroud thereof embodies a bulbous inlet.

Yet an object of the present invention is to provide such a new and improved MRFC solid nozzle tip for use in a firing system of the type utilized in a pulverized solid fuel-fired furnace that is characterized in that the exit plane corners of the primary air shroud thereof are rounded.

Yet a further object of the present invention is to provide such a new and improved MRFC solid fuel nozzle tip for use in a firing system of the type utilized in a pulverized solid fuel-fired furnace that is characterized in that the exit plane corners of the secondary air shroud thereof are rounded.

Yet another object of the present invention is to provide such a new and improved MRFC solid fuel nozzle tip for use in a firing system of the type utilized in a pulverized solid fuel-fired furnace that is characterized in that the secondary air shroud thereof is provided with a uniform opening.

Yet still another object of the present invention is to provide such a new and improved MRFC solid fuel nozzle tip for use in a firing system of the type utilized in a pulverized solid fuel-fired furnace that is characterized in that for purposes of attaining therewith minimum $NO_X$ emissions and/or minimum carbon in the flyash one or more bluff bodies, each embodying a predefined geometry, are suitably supported in mounted relation at a predetermined location therewithin.

SUMMARY OF THE PRESENT INVENTION

In accordance with one embodiment of the present invention there is provided a solid fuel nozzle tip for use in a firing system of the type utilized in a pulverized solid fuel-fired furnace. The subject solid fuel nozzle tip, in accordance with this one embodiment of the present invention, is constructed so as to be capable of operation as a minimum recirculation flame control (MRFC) solid fuel nozzle tip. To this end, the subject MRFC solid fuel nozzle tip is streamlined aerodynamically to prevent low or negative velocities at the exit of the MRFC solid fuel nozzle tip, which otherwise could provide sites for the deposition thereat of solid fuel particles. As such, the subject MRFC solid fuel nozzle tip is thus effective in eliminating field problems, which heretofore have existed and which have been occasioned by the fact that solid fuel nozzle tip deposits have occurred when certain "bad slagging" solid fuel types, i.e., those having high sulfur/iron content are being fired. Such field problems, in turn, have ultimately resulted in premature failure of the solid fuel nozzle tips embodying prior art forms of construction.

The nature of the construction of the subject MRFC solid fuel nozzle tip, in accordance with this one embodiment thereof, is such that the subject MRFC solid fuel nozzle tip includes secondary air shroud means, primary air shroud means located within the secondary air shroud means, secondary air shroud support means operative for supporting the primary air shroud means within the secondary air shroud means, and splitter plate means mounted in supported relation within the primary air shroud means. The secondary air shroud means embodies a bulbous configuration at the inlet thereof whereby bypassing of the secondary air around the secondary air shroud means during tilt conditions is minimized and whereby the cooling effect of the secondary air flow through the secondary air shroud means is enhanced. In addition at the exit end thereof the secondary air shroud means embodies rounded corners that in turn provide for higher corner velocities thus minimizing low velocity regions on the secondary air shroud means whereat solid fuel particle deposition could occur. With regard to the primary air shroud means, the primary air shroud means at the exit plane thereof is recessed to within the exit plane of the secondary air shroud means whereby the exit plane of the primary air shroud means is removed as a potential deposition surface for solid fuel particles. In addition, the primary air shroud means embodies a tapered trailing edge that is operative to reduce the recirculation region at the trailing edge of the primary air shroud means that might otherwise be operative to draw hot particulate matter back to the trailing edge surface of the primary air shroud means and thereby create or exacerbate thereat the solid fuel particle deposition phenomena. The primary air shroud also embodies rounded exit plane corners that operate to increase velocities in the corners that in turn assist in helping to avoid deposition of solid fuel particles thereat, and in the event such deposition does occur helps in effecting the removal thereof. In addition, the rounded exit plane corners of the primary air shroud means coupled with the rounded exit plane corners of the secondary air shroud means provide the subject MRFC solid fuel nozzle tip with a uniform secondary air shroud opening, which in turn provides for uniform secondary air flow distribution within the subject MRFC solid fuel nozzle tip. Next, as regards the secondary air shroud support means, the secondary air shroud support means is recessed relative to the exit plane of the MRFC solid fuel nozzle tip so as to keep the recirculation region and vehicle deposition surface normally created thereby away from the exit plane of the MRFC solid fuel nozzle tip, thus reducing the secondary air shroud support means' possible influence in the deposition process. Further, structurally, recessing the secondary air shroud support means also allows the front portion of the secondary air shroud means and the front portion of the primary air shroud means to independently expand and thereby reduce thermally induced stress. Lastly, insofar as the splitter plate means is concerned, the splitter plate means along with the primary air shroud means is recessed, reference having been made hereinbefore to the recessing of the primary air shroud means, to within the exit plane of the secondary air shroud means thereby removing the splitter plate means as well as the primary air shroud as surfaces susceptible to potential depositions arising from the firing zone, i.e., the exit plane of the MRFC solid fuel nozzle tip. Also, such recessing is effective for purposes of providing some cooling via the shielding effect provided by the secondary air shroud means. In addition, such recessing of the splitter plate means results in a shorter splitter plate means thereby reducing the contact surface for heat transfer thereto as well as the contact surface for the deposition of solid fuel particles thereon. Furthermore, the ends of the splitter plate means are tapered but at a small enough angle to avoid primary air separation, which cause the creation of additional unwanted flow recirculation. Such tapering of the ends of the splitter plate means is effective in reducing the recirculation region that has served to adversely affect the operation of prior art forms of solid fuel nozzle tips, which are characterized by the fact that they embody a blunt faced trailing edge, and in reducing the shed vortices that are created by such blunt faced trailing edges. If the splitter plate means were to embody blunt ends, the recirculation region induced thereby would operate to draw hot particulate back thereto and thus would have the effect of creating or exacerbating the solid fuel deposition phenomena. Such a recirculation region is also capable of providing conditions conducive to combustion, thus creating flames within the recirculation region, which would have the effect of raising temperatures and further exacerbating the deposition problem. Moreover, leading edge induced vortices created by blunt faced edges occasion increased turbulence levels within the primary air stream and thus exacerbate solid fuel particulate deposition on such edges, a result that is obviated when tapered edges are employed rather than blunt edges.

In accordance with a second embodiment of the present invention there is provided a minimum recirculation flame control (MRFC) solid fuel nozzle tip that is particularly suited for use in firing systems of the type employed in pulverized solid fuel-fired furnaces and which is characterized in the inclusion therewithin of positive means operative to effect a cooling of the inner, i.e., primary air, shroud means of the MRFC solid fuel nozzle tip. Namely, in certain applications wherein particular types of solid fuel are being combusted the possibility exists that the trailing edge of the primary air shroud means may become sufficiently hot because of heat being radiated thereto from the secondary air shroud means to cause melting of the solid fuel as the solid fuel flows through the primary air shroud means whereupon deposition of the melted solid fuel on the trailing edge of the primary air shroud means could occur. Accordingly, for use in such applications it is desirable that the MRFC solid fuel nozzle tip be modified so as to incorporate therewithin cooling means operative to preclude the trailing edge of the primary air shroud means from becoming sufficiently hot from heat being radiated thereto from the secondary air shroud means that melting of the solid fuel could otherwise occur as the solid fuel flows through the primary air shroud means. To this end, in accordance with this second embodiment thereof the MRFC solid fuel nozzle tip is provided with shielding means suitably interposed between the trailing edge of the primary air shroud means and the trailing edge of the secondary air shroud means. This subject shielding means may take either of two forms. In accordance with the first form thereof, the shielding means comprises an "off-set" deflector member that is physically separated from the primary air shroud means so that the "off-set" deflector member effectively cools the primary air shroud means and in particular the trailing edge thereof by acting as a shield between the primary air shroud means and the secondary air shroud means such that radiant heating of the primary air shroud means from the secondary air shroud means is sufficiently minimized to prevent the trailing edge of the primary air shroud means from becoming sufficiently heated that the primary air shroud means becomes hot enough to cause melting of the solid fuel as the solid fuel flows through the primary air shroud means. In addition, the "off-set" deflector member is suitably designed so as to be operative to direct a portion of the secondary air, i.e., secondary air, which flows through the annulus formed between the inner surface of the secondary air shroud means and the outer surface of the primary air shroud means, towards, in a converging manner thereto, the primary air/solid fuel stream that is exiting from the trailing edge of the primary air shroud means. The convergence of this portion of the secondary air, i.e., secondary air, with the primary air/solid fuel stream creates turbulence in the area of convergence and enhanced ignition of the solid fuel without the flame resulting from such ignition becoming attached to the MRFC solid fuel nozzle tip. In accordance with the second form thereof the shielding means comprises a converging/diverging deflector member that is capable of shielding the primary air shroud means from heat being radiated thereto from the secondary air shroud means. At the time this converging/diverging deflector member is suitably designed so as to be operative to direct a first portion of the secondary air, i.e., secondary air, towards, in a converging manner thereto, the primary air/solid fuel stream exiting from the annulus formed between the inner surface of the secondary air shroud means and the outer surface of the primary air shroud means and so as to be operative to direct a second portion of the secondary air, i.e., secondary air, away from, in a diverging manner thereto, the aforementioned primary air/solid fuel stream. As in the case of the first form of shielding means to which reference has been had hereinbefore, the converging/diverging deflector member in accordance with the second form of shielding means also provides for enhanced ignition of low volatile solid fuels without the flame resulting from such ignition attaching to the MRFC solid fuel nozzle tip.

In accordance with a third embodiment of the present invention there is provided a minimum recirculation flame control (MRFC) solid fuel nozzle tip that is particularly suited for use in firing systems of the type employed in pulverized solid fuel-fired furnaces and which is characterized in that control of the flame front is capable of being had therewith without resorting to the use of anything that would protrude outwardly of the MRFC solid fuel nozzle tip and into the firing zone of the pulverized solid fuel-fired furnace. To this end, the third embodiment of the subject MRFC solid fuel nozzle tip embodies cone forming means suitably positioned within the primary air shroud means in supported relation thereto at the exit end of the MRFC solid fuel nozzle tip. The subject cone forming means is operative for effecting flame front positioning without the creation of recirculation pockets at the exit end of the MRFC solid fuel nozzle tip and also without the creation of surface features, which would be susceptible to deposition of solid fuel particles thereon. In addition, the subject cone forming means is operative to effect ignition uniformly across the primary air/solid fuel stream of the solid fuel. The foregoing is accomplished by virtue of the fact that a "icone" is created by the subject cone forming means, which is operative to divide the primary air/solid fuel stream into two streams each capable of having a different velocity and momentum whereby the third embodiment of MRFC solid fuel nozzle tips can be made to have a wide range of velocity and momentum values as required for purposes of controlling at the exit end of the MRFC solid fuel nozzle tip the aerodynamics existing thereat, which in turn influence flame front position and flame characteristics. Basically, the variables that have been used in determining the nature of the cone that is created through the use of the cone forming means are the inlet area of the cone created by the cone forming means as compared to the inlet area of the MRFC solid fuel nozzle tip and the exit area of the cone created by the cone forming means as compared to the exit area of the MRFC solid fuel nozzle tip. Moreover, if so desired, the cone created by the cone forming means could be made to include mechanisms for imparting swirl to the primary air stream, the secondary air stream or both, and for controlling mixing between the primary air stream and the secondary air stream.

In accordance with a fourth embodiment of the present invention there is provided a minimum recirculation flame control (MRFC) solid fuel nozzle tip that is particularly suited for use in firing systems of the type employed in pulverized solid fuel-fired furnaces and which is characterized by the inclusion therewithin of means operative for purposes of achieving through the use thereof minimum $NO_X$ emissions and/or minimum carbon in the flyash. To this end, the fourth embodiment of the subject MRFC solid fuel nozzle tip embodies splitter plates, which include alternating wedge-shaped bluff bodies together with solid fuel stream flow obstructions to disperse the solid fuel jet. This design of splitter plates with wedge-shaped bluff bodies embodies in terms of the number, geometry, size, overlap therebetween and location of the wedge-shaped bluff bodies, which are employed, that which are needed in order to optimize therewith the number of "trip points", which are required in order to effect as a consequence of the employment thereof a dispersion of the solid fuel jet, while yet maintaining the aforereferenced "trip points" as individually distinct locations. Continuing, the wedge-shaped bluff bodies are located centrally of the splitter plates such that the flat, chambered, recessed, trailing edge sections thereof are positioned on the splitter plates where the splitter plates mate with the secondary air shroud in order to thereby prevent any deposition of hot particulates from propagating to the surface of the splitter plates. If so desired, for purposes of controlling the erosion thereof the leading edges of the splitter plates as well as the leading edges of the wedge-shaped bluff body solid fuel jet "trip points" may have a weld overlay of a conventional form of erosion resistant material, which is suitable for use for such a purpose, applied thereto.

DESCRIPTION OF THE PREFERRED EMBODIMENT

Figure 1:
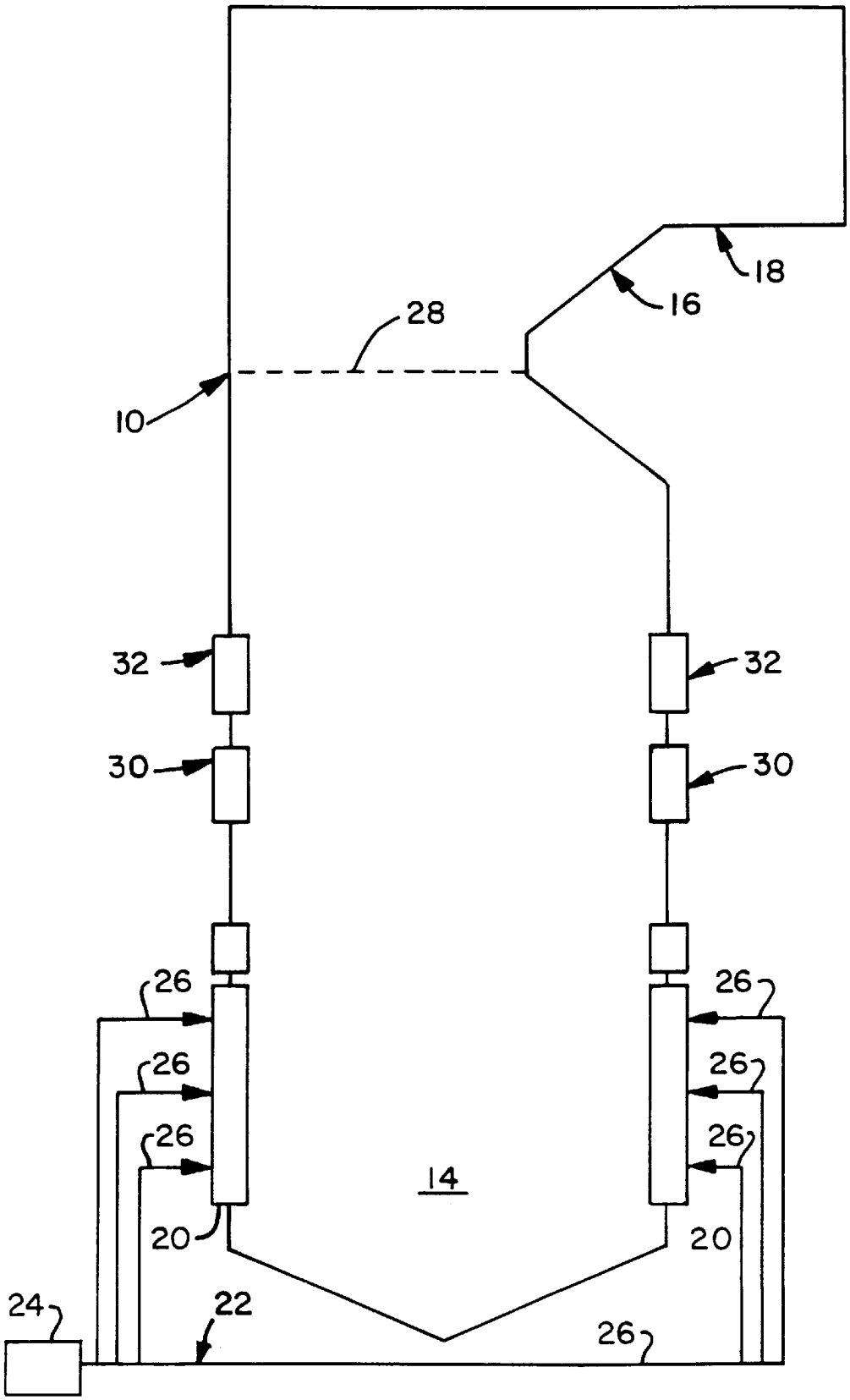
FIG. 1 is a diagrammatic representation in the nature of a vertical sectional view of a pulverized solid fuel-fired furnace embodying a firing system with which a minimum recirculation flame control (MRFC) solid fuel nozzle tip construction in accordance with the present invention may be utilized.

Referring now to the drawing, and more particularly to FIG. 1 thereof, there is depicted therein a pulverized solid fuel-fired furnace, generally designated by reference numeral 10. Inasmuch as the nature of the construction and the mode of operation of pulverized solid fuel-fired furnaces per se are well known to those skilled in the art, it is not deemed necessary, therefore, to set forth herein a detailed description of the pulverized solid fuel-fired furnace 10 illustrated in FIG. 1. Rather, for purposes of obtaining an understanding of a pulverized solid fuel-fired furnace 10 in the firing system of which a minimum recirculation flame control (MRFC) solid fuel nozzle tip constructed in accordance with the present invention, a first embodiment thereof being generally designated by the reference numeral 12 in FIGS. 3 and 4 of the drawing, is particularly suited for employment, it is deemed to be sufficient that there be presented herein merely a description of the nature of the components of the pulverized solid fuel-fired furnace 10 and of the components of the firing system with which the pulverized solid fuel-fired furnace 10 is suitably provided and with which the MRFC solid fuel nozzle tip cooperates. For a more detailed description of the nature of the construction and the mode of operation of the components of the pulverized solid fuel-fired furnace 10 and of the firing system with which the pulverized solid fuel-fired furnace 10 is suitably provided, which are not described herein, one may have reference to the prior art, i.e., in the case of the pulverized solid fuel-fired furnace 10 to U.S. Pat. No. 4,719,587, which issued Jan. 12, 1988 to F. J. Berte and which is assigned to the same assignee as the present patent application and, in the case of the firing system with which the pulverized solid fuel-fired furnace 10 is suitably provided, to U.S. Pat. No. 5,315,939, which issued May 31, 1994 to M. J. Rini et al. and which is assigned to the same assignee as the present patent application.

Referring further to FIG. 1 of the drawing, the pulverized solid fuel-fired furnace 10 as illustrated therein includes a burner region, generally designated by the reference numeral 14. It is within the burner region 14 of the pulverized solid fuel-fired furnace 10 that in a manner well-known to those skilled in this art combustion of the pulverized solid fuel and air is initiated. The hot gases that are produced from combustion of the pulverized solid fuel and air rise upwardly in the pulverized solid fuel-fired furnace 10. During the upwardly movement thereof in the pulverized solid fuel-fired furnace 10, the hot gases in a manner well-known to those skilled in this art give up heat to the fluid passing through the tubes (not shown in the interest of maintaining clarity of illustration in the drawing) that in conventional fashion line all four of the walls of the pulverized solid fuel-fired furnace 10. Then, the hot gases exit the pulverized solid fuel-fired furnace 10 through the horizontal pass, generally designated by the reference numeral 16, of the pulverized solid fuel-fired furnace 10, which in turn leads to the rear gas pass, generally designated by the reference numeral 18, of the pulverized solid fuel-fired furnace 10. Both the horizontal pass 16 and the rear gas pass 18 commonly contain other heat exchanger surface (not shown) for generating and superheating steam, in a manner well-known to those skilled in this art. Thereafter, the steam commonly is made to flow to a turbine (not shown), which forms one component of a turbine/generator set (not shown), such that the steam provides the motive power to drive the turbine (not shown) and thereby also the generator (not shown), which in known fashion is cooperatively associated with the turbine, such that electricity is thus produced from the generator (not shown).

With the preceding by way of background, reference is once again had to FIG. 1 of the drawing for purposes of setting forth herein a description of the nature of the construction and the mode of operation of the firing system with which the pulverized solid fuel-fired furnace 10, depicted in FIG. 1 of the drawing, is suitably provided. Continuing, the subject firing system as seen with reference to FIG. 1 of the drawing includes a housing preferably in the form of a main windbox, which is identified in FIG. 1 by the reference numeral 20. In a manner well-known to those skilled in the art, the windbox 20 in known fashion is provided with a plurality of air compartments (not shown) through which air supplied from a suitable source thereof (not shown) is injected into the burner region 14 of the pulverized solid fuel-fired furnace 10. In addition, the windbox 20 in a manner well-known to those skilled in the art is provided with a plurality of fuel compartments (not shown) through which solid fuel is injected into the burner region 14 of the pulverized solid fuel-fired furnace 10. The solid fuel, which is injected through the aforereferenced plurality of fuel compartments (not shown), is supplied to this plurality of fuel compartments (not shown) by means of a pulverized solid fuel supply means, denoted generally by the reference numeral 22 in FIG. 1 of the drawing. To this end, the pulverized solid fuel supply means 22 includes a pulverizer, denoted generally by the reference numeral 24 in FIG. 1, and a plurality of pulverized solid fuel ducts, denoted in FIG. 1 by the reference numeral 26. In a fashion well-known to those skilled in the art, the pulverized solid fuel is transported through the pulverized solid fuel ducts 26 from the pulverizer 24 to which the pulverized solid fuel ducts 26 are connected in fluid flow relation to the previously mentioned plurality of fuel compartments (not shown) to which the pulverized solid fuel ducts 26 are also connected in fluid flow relation. Although not shown in the interest of maintaining clarity of illustration in the drawing, the pulverizer 24 is operatively connected to a fan (not shown), which in turn is operatively connected in fluid flow relation with the previously mentioned plurality of air compartments (not shown), such that air is supplied from the fan (not shown) to not only the aforesaid plurality of air compartments (not shown) but also to the pulverizer 24 whereby the pulverized solid fuel supplied from the pulverizer 24 to the aforesaid plurality of fuel compartments (not shown) is transported through the pulverized solid fuel ducts 26 in an air stream in a manner which is well known to those skilled in the art of pulverizers.

In further regard to the nature of the firing system with which the pulverized solid fuel-fired furnace 10, which is illustrated in FIG. 1 of the drawing, is suitably provided, two or more discrete levels of separated overfire air are incorporated in each corner of the pulverized solid fuel-fired furnace 10 so as to be located between the top of the main windbox 20 and the furnace outlet plane, depicted by the dotted line 28 in FIG. 1, of the pulverized solid fuel-fired furnace 10. To this end, in accordance with the illustration of the pulverized solid fuel-fired furnace 10 in FIG. 1 of the drawing, the firing system with which the pulverized solid fuel-fired furnace 10 is suitably provided embodies two or more discrete levels of separated overfire air, i.e., a low level of separated overfire air denoted generally in FIG. 1 of the drawing by the reference numeral 30 and a high level of separated overfire air denoted generally in FIG. 1 of the drawing by the reference numeral 32. The low level 30 of separated overfire air is suitably supported through the use of any conventional form of support means (not shown) suitable for use for such a purpose within the burner region 14 of the pulverized solid fuel-fired furnace 10 so as to be suitably spaced from the top of the windbox 20, and so as to be substantially aligned with the longitudinal axis of the main windbox 20. Similarly, the high level 32 of separated overfire air is suitably supported through the use of any conventional form of support means (not shown) suitable for use for such a purpose within the burner region 14 of the pulverized solid fuel-fired furnace 10 so as to be suitably spaced from the low level 30 of separated overfire air, and so as to be substantially aligned with the longitudinal axis of the main windbox 20. The low level 30 of separated overfire air and the high level 32 of separated overfire air are suitably located between the top of the main windbox 20 and the furnace outlet plane 28 such that it will take the gases generated from the combustion of the pulverized solid fuel a preestablished amount of time to travel from the top of the main windbox 20 to the top of the high level 32 of separated overfire air.

Figure 2:
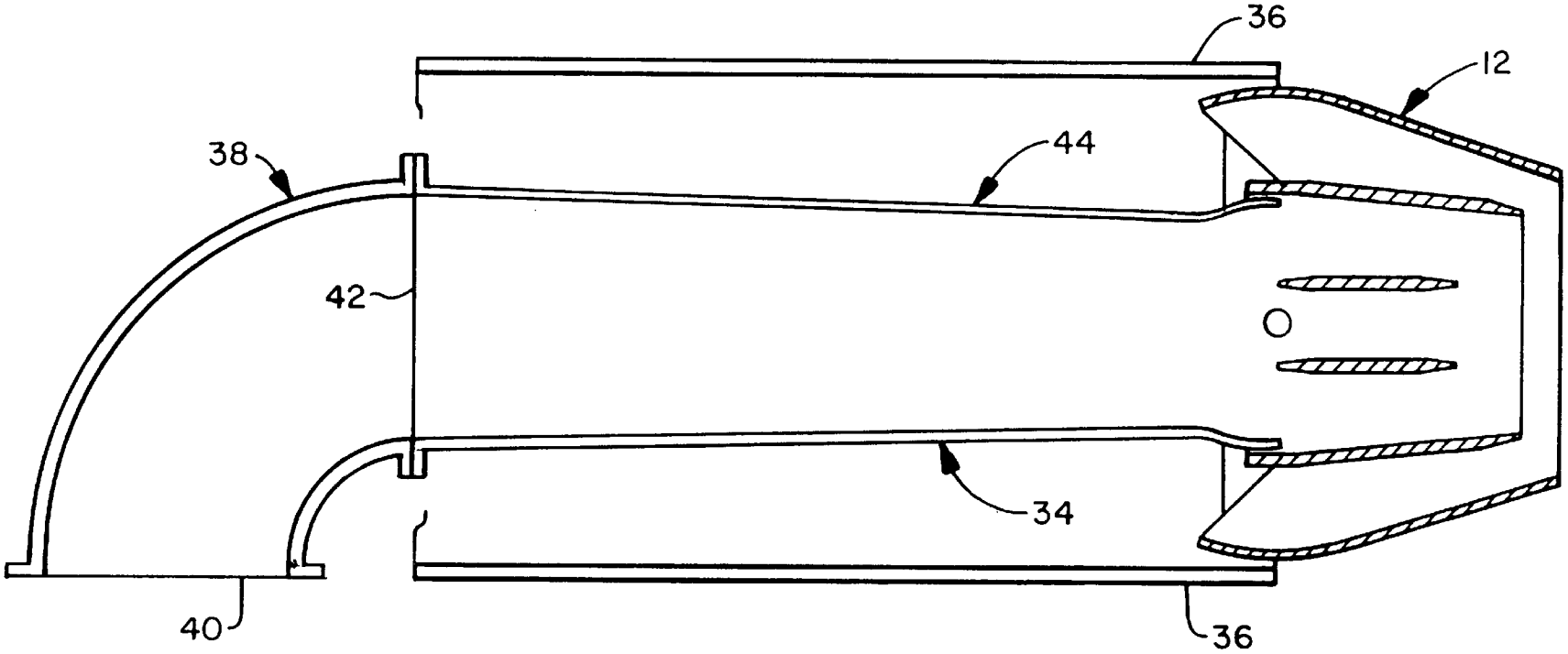
FIG. 2 is a side elevational view of a pulverized solid fuel nozzle, which is illustrated in FIG. 2 embodying a first embodiment of a minimum recirculation flame control (MRFC) solid fuel nozzle tip construction in accordance with the present invention, of the type employed in the firing system of the pulverized solid fuel-fired furnace that is illustrated in FIG. 1.

Referring next to FIG. 2 of the drawing, there is depicted therein a pulverized solid fuel nozzle, denoted generally therein by the reference numeral 34. In accordance with the illustration thereof in FIG. 2 of the drawing, the pulverized solid fuel nozzle 34 is depicted as embodying a first embodiment of a MRFC solid fuel nozzle tip 12 constructed in accordance with the present invention. A pulverized solid fuel nozzle 34, in a manner well-known to those skilled in the art, is suitably supported in mounted relation within each of the plurality of fuel compartments (not shown) to which reference has been had hereinbefore. In this regard, a schematic representation of one of the plurality of fuel compartments (not shown) is denoted in FIG. 2 by the reference numeral 36.

Any conventional form of mounting means suitable for use for such a purpose may be employed to mount the pulverized solid fuel nozzle 34 in the fuel compartment 36. The pulverized solid fuel nozzle 34, as best understood with reference to FIG. 2 of the drawing, includes an elbow-like portion denoted generally in FIG. 2 by the reference numeral 38 that is designed, although it has not been depicted in FIG. 2 in the interest of maintaining clarity of illustration therewithin, to be operatively connected at one end, i.e., the end thereof denoted in FIG. 2 by the reference numeral 40, to a pulverized solid fuel duct 26. The other end, i.e., that denoted by the reference numeral 42, of the elbow-like portion 38, as seen with reference to FIG. 2 of the drawing, is operatively connected through the use of any conventional form of fastening means suitable for use for such a purpose to the longitudinally extending portion, denoted generally in FIG. 2 by the reference numeral 44. The length of the longitudinally extending portion 44 is such as to essentially correspond to the depth of the fuel compartment 36. The pulverized solid fuel nozzle 34, as has been set forth herein previously, embodies a first embodiment of a MRFC solid fuel nozzle tip 12, the nature of the construction and the mode of operation of which will be described herein in greater detail subsequently.

For purposes of setting forth herein a description of the nature of the construction and the mode of operation of the MRFC solid fuel nozzle tip 12, reference will be had to FIGS. 3–8 of the drawing. As has been stated hereinbefore the MRFC solid fuel nozzle tip 12 constructed in accordance with the present invention is advantageously characterized, by way of exemplification and not limitation, in each of the following respects. Namely, by virtue of the nature of the construction and the mode of operation of the MRFC solid fuel nozzle tip 12, low and negative, i.e., recirculation, velocity regions at the exit plane of the MRFC solid fuel nozzle tip 12 are minimized; available deposition surface on the MRFC solid fuel nozzle tip 12 is reduced; the nozzle tip/solid fuel nozzle thermal conditions can be varied to keep the "hot" particulate matter from depositing on available metal platework surfaces of the MRFC solid fuel nozzle tip 12; and it is possible therewith to achieve concomitantly with the foregoing minimum $NO_X$ emissions and/or minimum carbon in the flyash.

Figure 3:
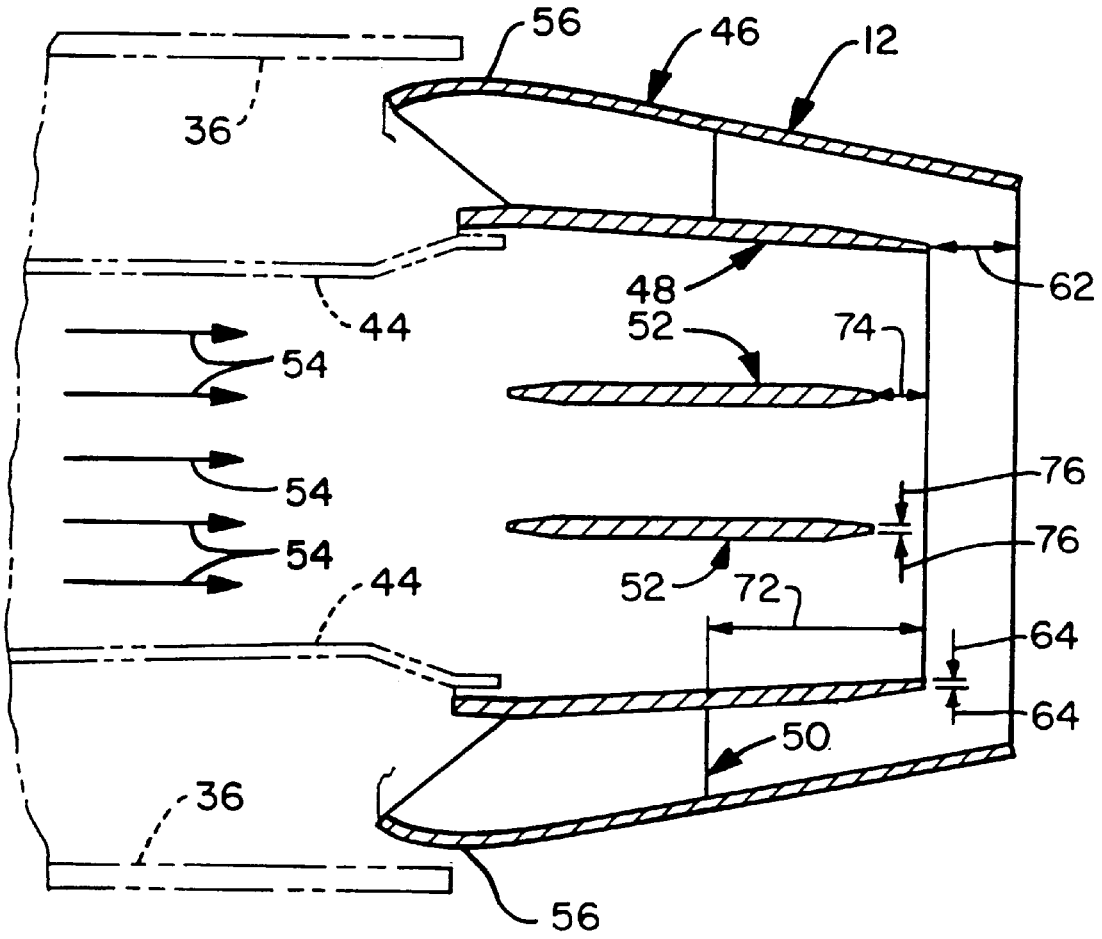
FIG. 3 is a side elevational view with parts broken away of the first embodiment of a minimum recirculation flame control (MRFC) solid fuel nozzle tip constructed in accordance with the present invention that is illustrated in FIG. 2.
Figure 4:
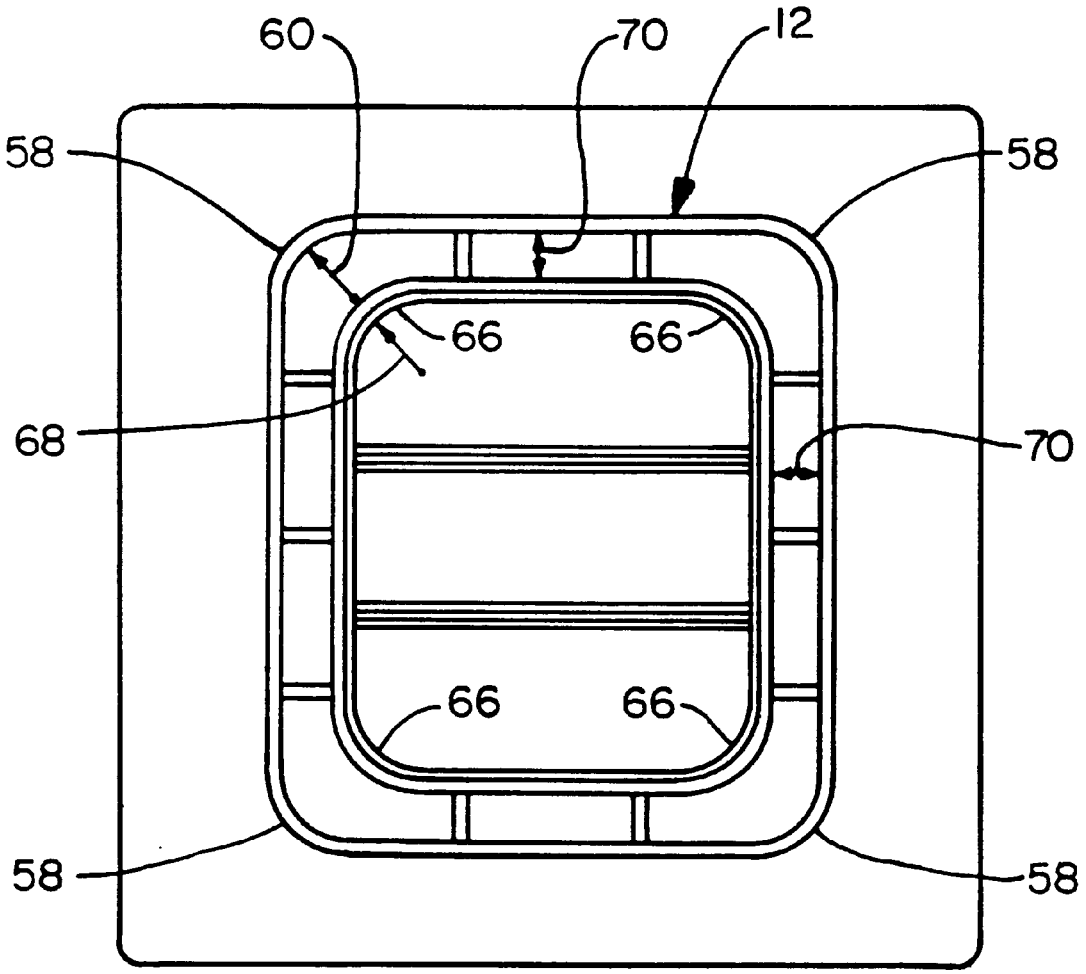
FIG. 4 is an end view of the first embodiment of a minimum recirculation flame control (MRFC) solid fuel nozzle tip constructed in accordance with the present invention that is illustrated in FIG. 2.
Figure 5:
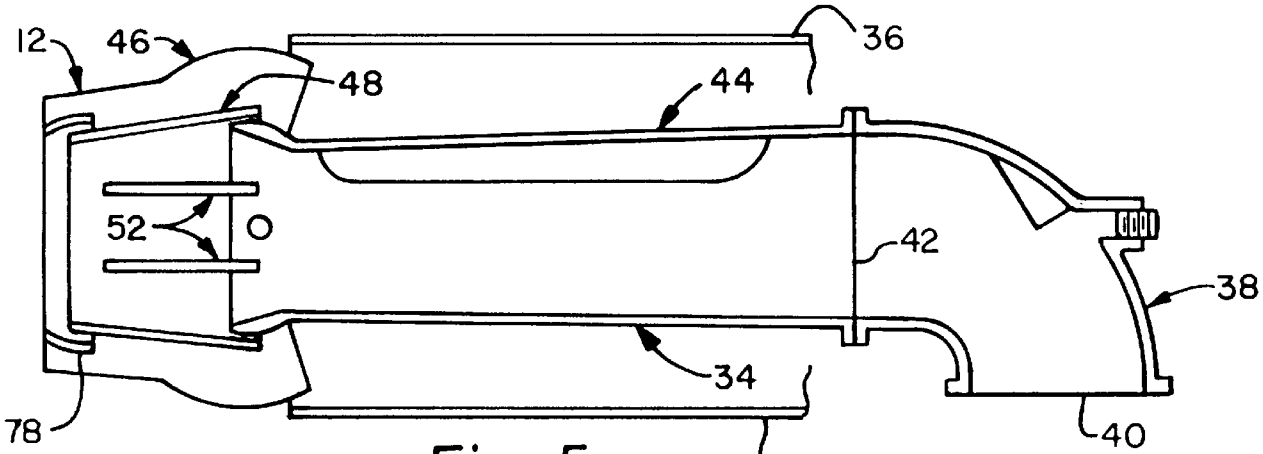
FIG. 5 is a side elevational view of a pulverized solid fuel nozzle, which is illustrated in FIG. 5 as embodying a first form of a second embodiment of a minimum recirculation flame control (MRFC) solid fuel nozzle tip constructed in accordance with the present invention, of the type employed in the firing system of the pulverized solid fuel-fired furnace illustrated in FIG. 1.

There are four embodiments of the MRFC solid fuel nozzle tip 12 constructed in accordance with the present invention that are described and illustrated in the instant application. The first of these four embodiments can be found depicted in FIGS. 2, 3 and 4 of the drawing. Reference will be had in particular to FIGS. 3 and 4 of the drawing for purposes of setting forth herein a description of the nature of the construction and the mode of operation of the first embodiment of the MRFC solid fuel nozzle tip 12, which for ease of reference herein will be deemed to be identified also by the reference numeral 12. Thus, as will be best understood with reference to FIGS. 3 and 4 of the drawing the first embodiment of the MRFC solid fuel nozzle tip 12 includes secondary air shroud means, denoted therein generally by the reference numeral 46; primary air shroud means, denoted therein generally by the reference numeral 48; secondary air shroud support means, denoted therein generally by the reference numeral 50; and splitter plate means, denoted therein generally by the reference numeral 52. To facilitate the acquiring of an understanding of the nature of the construction and the mode of operation of the first embodiment of the MRFC solid fuel nozzle tip 12, there is schematically depicted in FIG. 3 of the drawing through the use of dotted lines, a schematic representation seen at 36 of a portion of a fuel compartment and a schematic representation seen at 44 of the longitudinally extending portion of the pulverized solid fuel nozzle 34. Note is further made herein at this time to the fact that the direction of flow of the primary air and pulverized solid fuel to the first embodiment of the MRFC solid fuel nozzle tip 12 is depicted in FIG. 3 of the drawing through the use of the arrows, which are identified therein by means of the reference numeral 54.

Continuing, the secondary air shroud means 46, as best understood with reference to FIG. 3 of the drawing, embodies at the inlet end thereof a bulbous configuration identified by the reference numeral 56. The bulbous configuration 56 is operative to minimize the possibility that secondary air will bypass the secondary air shroud means 46, i.e., will not flow through the secondary air shroud means 46 as intended, particularly under tilt conditions, i.e., when the secondary air shroud means 46 is an upwardly tilt position or a downwardly tilt position relative to the centerline of the MRFC solid fuel nozzle tip 12. Should secondary air bypass the secondary air shroud means 46 this also has the concomitant effect of adversely impacting the extend to which the secondary air is capable of carrying out the cooling effect on the secondary air shroud means 46 desired therefrom. In addition to the bulbous configuration 56 thereof, the secondary air shroud means 46 is further characterized by the embodiment therein of rounded corners, denoted in FIG. 4 of the drawing by the reference numeral 58. Namely, for a purpose to which further reference will be had herein each of the rounded corners 58 of the secondary air shroud means 46 is made to embody the same predetermined radius, which for ease of reference thereto is depicted by the arrow identified by the reference numeral 60 in FIG. 4 of the drawing. The rounded corners 58 of the secondary air shroud means 46 operate to provide higher velocities in the corners of the secondary air shroud means 46, which in turn effectively minimize the existence of low velocity regions on the secondary air shroud means 46 that might otherwise lead to unwanted solid fuel deposition.

A description will next be had herein of the nature of the construction and the mode of operation of the primary air shroud means 48 of the first embodiment of the MRFC solid fuel nozzle tip 12. For this purpose reference will once again be had to FIGS. 3 and 4 of the drawing. The primary air shroud means 48, as will be best understood with reference to FIG. 3 of the drawing, is characterized in a first respect by the fact that the trailing edge of the primary air shroud means 48 is recessed relative to the trailing edge of the secondary air shroud means 46 by a predetermined distance. This predetermined distance is depicted in FIG. 3 of the drawing by the arrow identified therein by the reference numeral 62. By virtue of being recessed relative to the trailing edge of the secondary air shroud means 46, the exit plane of the primary air shroud means 48 and more specifically the trailing edge of the primary air shroud means 48 is removed as a potential deposition surface of solid fuel particles.

In addition to the foregoing, the primary air shroud means 48 is characterized in a second respect further by the fact that the trailing edge thereof is tapered by a predetermined amount. This predetermined amount of taper, which is depicted in FIG. 3 by the arrows that are each identified by the same reference numeral, i.e., reference numeral 64, is purposely made small enough, i.e., the angle of taper is made small enough, such that neither the secondary air nor the primary air, which are flowing on either side thereof separate from the trailing edge surface of the primary air shroud means 48, which if they did could result in the creation of additional, unwanted recirculation.

Continuing with the description of the nature of the construction and mode of operation of the primary air shroud means 48, as best understood with reference to FIG. 4 of the drawing the primary air shroud means 48 is characterized in a third respect additionally by the fact that the primary air shroud means 48 is also provided with rounded corners, denoted therein by the reference numeral 66. More specifically, each of the rounded corners 66 of the primary air shroud means 48 is made to embody a second predetermined radius, which for ease of reference is depicted by the arrow that is identified by the reference numeral 68 in FIG. 4 of the drawing. The rounded corners 66 of the primary air shroud means 48 are thus operative to increase velocities in the corners 66 of the primary air shroud means 48 that in turn assist in helping to avoid deposition of solid fuel particles in the corners 66 of the primary air shroud means 48, and in the event such deposition does occur helps in effecting the removal thereof. Furthermore, the rounded exit plane corners 66 of the primary air shroud means 48 coupled with the rounded exit plane corners 58 of the secondary air shroud means 46 operate to provide the first embodiment of MRFC solid fuel nozzle tip 12 with a uniform secondary air flow distribution within the first embodiment of the MRFC solid fuel nozzle tip 12. Namely, uniform spacing exists between the outer surface of the primary air shroud means 48 and the inner surface of the secondary air shroud means 46 throughout the entire space that exists therebetween. For ease of reference this uniform spacing between the inner surface of the secondary air shroud means 46 and the outer surface of the primary air shroud means 48 is depicted in FIG. 4 of the drawing through the use of the arrows that are denoted therein by means of the reference numeral 70. Such uniform secondary air flow distribution within the first embodiment of the MRFC solid fuel nozzle tip 12 in turn provides not only for uniform cooling of the first embodiment of the MRFC solid fuel nozzle tip 12 by the secondary air stream, but also provides for uniform blanketing of the primary air stream by the secondary air stream so that control can thus be exercised both over the point of ignition of the solid fuel and over $NO_X$ emissions.

Next, a description will be had herein of the nature of the construction and the mode of operation of the secondary air shroud support means 50 of the first embodiment of the MRFC solid fuel nozzle tip 12. To this end, the secondary air shroud support means 50 is characterized in a first respect by the fact that the secondary air shroud support means 50 is recessed to a predetermined distance relative to the exit plane of the first embodiment of the MRFC solid fuel nozzle tip 12 so as to keep the recirculation region and vertical deposition surface normally created thereby away from the exit plane of the first embodiment of the MRFC solid fuel nozzle tip 12. The effect of so recessing the secondary air shroud support means 50 relative to the exit plane of the first embodiment of the MRFC solid fuel nozzle tip 12 is to reduce the possible influence that the secondary air shroud support means 50 has on the deposition process. Furthermore, from a structural standpoint recessing the secondary air shroud support means 50 also allows both the trailing edge of the secondary air shroud means 46 and the trailing edge of the primary air shroud means 48 to expand independently of one another thereby reducing the stress that is induced thermally in both the secondary air shroud means 46 and the primary air shroud means 48. The predetermined distance to which the secondary air shroud support means is recessed relative to the exit plane of the first embodiment of the MRFC solid fuel nozzle tip 12 is for ease of understanding depicted in FIG. 3 of the drawing by the arrow identified therein by the reference numeral 72.

Lastly, there will now be set forth herein a description of the nature of the construction and the mode of operation of the splitter plate means 52 of the first embodiment of the MRFC solid fuel nozzle tip 12. The splitter plate means 52 is characterized in a first respect by the fact that the splitter plate means 52, like the primary air shroud means 48 that has been described hereinbefore, is recessed within the exit plane of the secondary air shroud means 46. Moreover, not only is the splitter plate means 52 recessed within the secondary air shroud means 46, but the splitter plate means 52 is also recessed to a predetermined distance relative to the trailing edge of the primary air shroud means 48. To facilitate an understanding thereof, this predetermined distance to which the splitter plate means 52 is recessed relative to the trailing edge of the primary air shroud means 48 is depicted in FIG. 3 by the arrow that is identified therein by the reference numeral 74. By being so recessed the splitter plate means 52 is thereby removed as a surface susceptible to potential deposition arising from the firing zone, i.e., the exit plane of the first embodiment of the MRFC solid fuel nozzle tip 12. Also, such recessing of the splitter plate means 52 is effective for purposes of providing some cooling to the splitter plate means 52 by virtue of the shielding effect provided thereto by the secondary air shroud means 46. In addition, such recessing of the splitter plate means 52 results in a splitter plate means 52 that is shorter in length, which in turn thus has the effect of reducing the contact surface for heat transfer thereto as well as reducing the contact surface for the deposition of particles thereon. In addition, the splitter plate means 52 is also characterized in a second respect by the fact that both ends of the splitter plate means 52 are tapered by a predetermined amount. To facilitate an understanding thereof, the extent to which the ends of the splitter plate means 52 are tapered is depicted in FIG. 3 of the drawing by the arrows that are each identified therein by the reference numeral 76. It should be noted herein that the predetermined amount by which the ends of the splitter plate means 52 are tapered is such that the angle of taper thereof is made small enough to prevent the separation relative thereto of the primary air that flows on either side thereof. If such separation of the primary air were to occur, it could have the effect of creating additional unwanted flow recirculation. Such tapering of the ends of the splitter plate means 52 is effective in reducing the recirculation region that has served to adversely affect the operation of prior art forms of solid fuel nozzle tips, which are characterized by the fact that they embody a blunt faced trailing edge. Secondly, such tapering of the ends of the splitter plate means is effective in reducing the shed vortices that are created by such blunt faced trailing edges. If the splitter plate means 52 were to embody blunt ends, the recirculation region induced thereby would operate to draw hot particulate back thereto and thus would have the effect of creating or exacerbating the solid fuel deposition phenomena. Such a recirculation region is also capable of providing conditions conducive to combustion, thus creating flames within the recirculation region, which would have the effect of raising temperatures and further exacerbating the deposition problem. Moreover, leading edge induced vortices created by blunt faced edges occasion increased turbulence levels within the primary air stream and thus exacerbate solid fuel particulate deposition on such edges, a result that is obviated when tapered edges are employed rather than blunt edges. Although the splitter plate means 52 is illustrated in FIGS. 3 and 4 of the drawing as comprising in accordance with the best mode embodiment of the invention a pair of individual splitter plates spaced equidistantly on either side of the centerline of the first embodiment of the MRFC solid fuel nozzle tip 12, it is to be understood that the splitter plate means 52 could comprise a different number of individual splitter plates without departing from the essence of the present invention.

A description will now be had herein of the nature of the construction of a second embodiment of MRFC solid fuel nozzle tip. For this purpose reference will be had to FIGS. 5 and 6 of the drawing wherein the second embodiment of the MRFC solid fuel nozzle tip is illustrated as being cooperatively associated with the solid fuel nozzle 34. In the interest of differentiating the second embodiment of MRFC solid fuel nozzle tip from the first embodiment of MRFC solid fuel nozzle tip 12 for purposes of the discussion thereof that follows, the second embodiment of MRFC solid fuel nozzle tip is denoted generally in FIGS. 5 and 6 of the drawing by the reference numeral 12'. However, any components of the second embodiment of the MRFC solid fuel nozzle tip 12' that are common to the second embodiment of the MRFC solid fuel nozzle tip 12' as well as to the first embodiment of the MRFC solid fuel nozzle tip 12 are identified by the same reference numeral in FIGS. 5 and 6 as that by which they are identified in FIGS. 3 and 4 of the drawing.

Continuing, the second embodiment of the MRFC solid fuel nozzle tip 12' is particularly characterized by the inclusion therewithin of positive means operative to effect a cooling of the primary air shroud means 48 of the second embodiment of the MRFC solid fuel nozzle tip 12'. Namely, in certain applications wherein particular types of solid fuel are being combusted the possibility exists that the trailing edge of the primary air shroud means 48 may become sufficiently hot because of heat radiated thereto from the secondary air shroud means 46 to cause melting of the solid fuel as the solid fuel flows through the primary air shroud means 48 whereupon deposition of the melted solid fuel on the trailing edge of the primary air shroud means 48 could occur. Accordingly, for use in such applications it is desirable that a second embodiment of the MRFC solid fuel nozzle tip, i.e., that denoted generally by the reference numeral 12' be provided. More specifically, for use in such applications it is desirable that the first embodiment of the MRFC solid fuel nozzle tip 12 be modified so as to incorporate therewithin cooling means, i.e., that a second embodiment of the MRFC solid fuel nozzle tip 12' be provided, which would be operative to preclude the trailing edge of the primary air shroud means 48 from becoming sufficiently hot from heat radiated thereto from the secondary air shroud means 46 that melting of the solid fuel could otherwise occur as the solid fuel flows through the primary air shroud means 48. To this end, in accordance with the second embodiment of the MRFC solid fuel nozzle tip 12' shielding means are provided suitably interposed between the trailing edge of the primary air shroud means 48 and the trailing edge of the secondary air shroud means 46. Such a shielding means may take either of two forms. In accordance with the first form thereof the shielding means, as best understood with reference to FIG. 5 of the drawing, comprises an "off-set" deflector member, denoted generally therein by the reference numeral 78. The "off-set" deflector member 78 is physically separated from the primary air shroud means 48 so that the "off-set" deflector member 78 effectively cools the primary air shroud means 48 and in particular the trailing edge thereof by acting as a shield between the primary air shroud means 48 and the secondary air shroud means 46 such that radiant heating of the primary air shroud means 48 from the secondary air shroud means 46 is sufficiently minimized to prevent the trailing edge of the primary air shroud means 48 from becoming sufficiently heated that the primary air shroud means 48 becomes hot enough to cause melting of the solid fuel as the solid fuel flows through the primary air shroud means 48. In addition, the "off-set" deflector member is suitably designed so as to be operative to direct a portion of the secondary air, which flows through the space provided for this purpose between the inner surface of the secondary air shroud means 46 and the outer surface of the primary air shroud means 48 towards, in a converging manner thereto, the primary air/solid fuel stream that is exiting from the trailing edge of the primary air shroud means 48. The convergence of this portion of the secondary air with the primary air/solid fuel stream creates turbulence in the area of convergence and enhanced ignition of the solid fuel without the flame resulting from such ignition becoming attached to the second embodiment of the MRFC solid fuel nozzle tip 12'.

Figure 6:
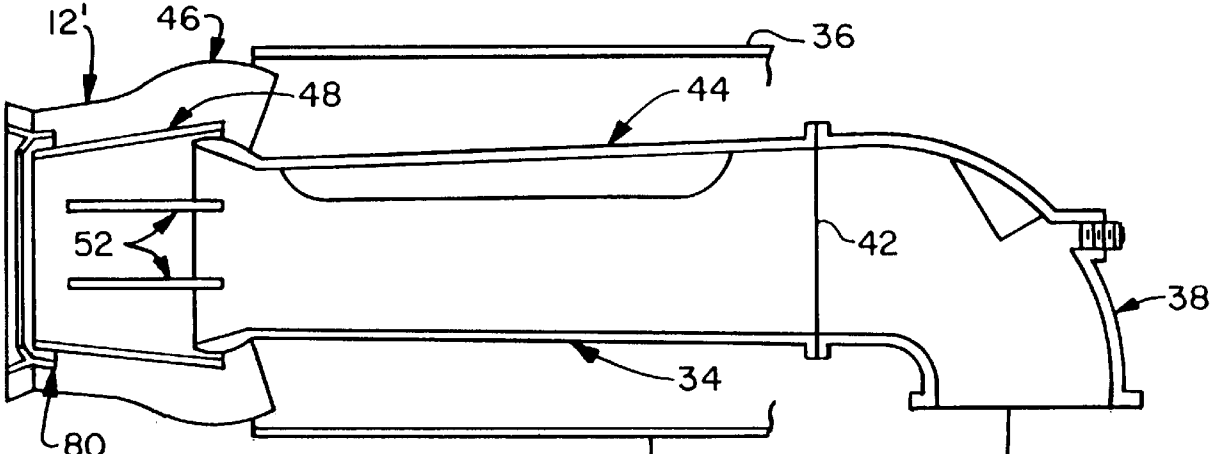
FIG. 6 is a side elevational view of a pulverized solid fuel nozzle, which is illustrated in FIG. 6 as embodying a second form of the second embodiment of a minimum recirculation flame control (MRFC) solid fuel nozzle tip constructed in accordance with the present invention, of the type employed in the firing system of the pulverized solid fuel-fired furnace illustrated in FIG. 1.

For purposes of discussing herein the second form of shielding means that the second embodiment of the MRFC solid fuel nozzle tip 12' may embody, reference will be had to FIG. 6 of the drawing. As best understood with reference to FIG. 6 of the drawing, the second form of shielding means comprises a converging/diverging deflector member, denoted generally therein by the reference numeral 80, that is capable of shielding the primary air shroud means 48 from heat being radiated thereto from the secondary air shroud means 46. At the same time this converging/diverging deflector member 80 is suitably designed so as to be operative to direct a first portion of the secondary air towards, in a converging manner thereto, the primary air/solid fuel stream exiting from the space, which is formed between the inner surface of the secondary air shroud means 48 and the outer surface of the primary air shroud means 46, so as to enable the flow therethrough of the secondary air. The converging/diverging deflector member 80 is further suitably designed so as to be operative to direct a second portion of the secondary air away from, in a diverging manner thereto, the aforereferenced primary air/solid fuel stream. As in the case of the first form of shielding means, the second form of shielding means, i.e., the converging/diverging deflector member 80, also provides for enhanced ignition of low volatile solid fuels without the flame resulting from such ignition attaching to the second embodiment of the MRFC solid fuel nozzle tip 12'.

Figure 7:
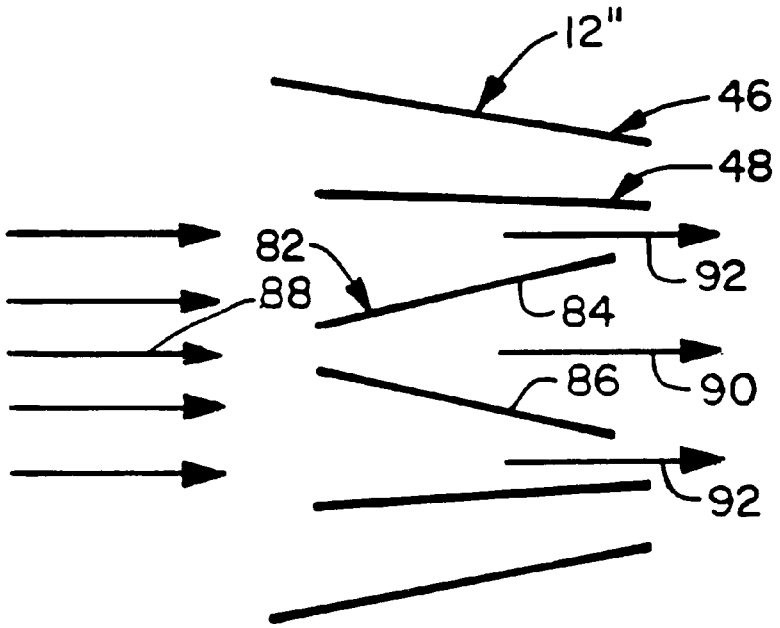
FIG. 7 is a schematic representation of a third embodiment of a minimum recirculation flame control (MRFC) solid fuel nozzle tip constructed in accordance with the present invention.
Figure 8:
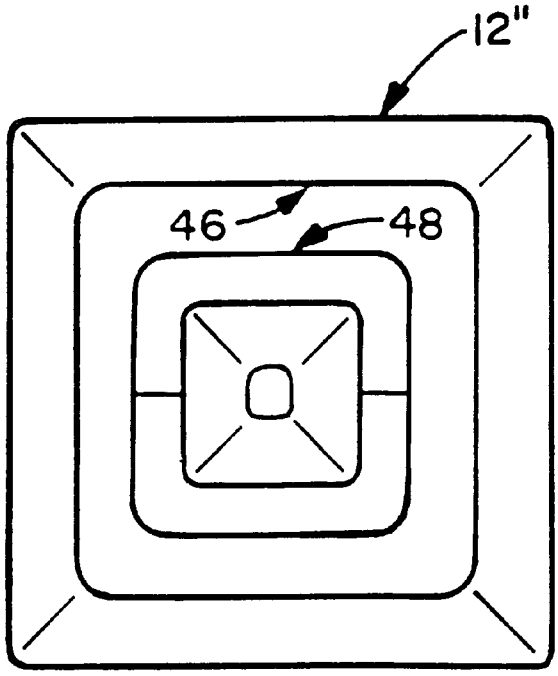
FIG. 8 is an end view of the third embodiment of a minimum recirculation flame control (MRFC) solid fuel nozzle tip constructed in accordance with the present invention.

A description will now be had herein of the nature of the construction and the mode of operation of the third embodiment of the MRFC solid fuel nozzle tip, which for purposes of differentiation from the first embodiment of the MRFC solid fuel nozzle tip 12 and the second embodiment of the MRFC solid fuel nozzle tip 12' is denoted generally in FIGS. 7 and 8 by the reference numeral 12". For purposes of the discussion thereof that follows those components of the third embodiment of the MRFC solid fuel nozzle tip 12", which are common to the third embodiment of the MRFC solid fuel nozzle tip 12" as well as to the second embodiment of the MRFC solid fuel nozzle tip 12' and the first embodiment of the MRFC solid fuel nozzle tip 12 are identified in FIGS. 7 and 8 of the drawing by the same reference numerals that have been employed to identify these components in connection with the illustration thereof in FIGS. 3 and 4 of the drawing and in connection with the illustration thereof in FIGS. 5 and 6 of the drawing.

Continuing, the third embodiment of the MRFC solid fuel nozzle tip 12" is characterized in that control of the flame front is capable of being had therewith without resorting to the use of anything that would protrude outwardly of the third embodiment of the MRFC solid fuel nozzle tip 12" and into the burner region 14 of the pulverized solid fuel-firing furnace 10. To this end, the third embodiment of the MRFC solid fuel nozzle tip 12" embodies cone forming means, denoted generally in FIG. 7 by the reference numeral 82. The cone forming means 82 is suitably positioned within the primary air shroud means 48 in supported relation thereto at the exit end of the third embodiment of the MRFC solid fuel nozzle tip 12". In accordance with the best mode embodiment thereof, the cone forming means 82 comprises a modified version of the splitter plate means 52. More specifically, as best understood with reference to FIG. 7 of the drawing the cone forming means 82 comprises a pair of splitter plates, denoted in FIG. 7 by the reference numerals 84 and 86, respectively. The cone forming means 82 is operative for effectuating flame front positioning without the creation of recirculation pockets at the exit end of the third embodiment of the MRFC solid fuel nozzle tip 12", and also without the creation of surface features, which would be susceptible to deposition of solid fuel particles thereon. In addition, the cone forming means 82 is operative to effect ignition of the solid fuel uniformly across the primary air/solid fuel stream. For ease of reference thereto, the primary air/solid fuel stream is depicted in FIG. 7 through the use of a plurality of arrows that are collectively identified therein generally by the reference numeral 88. This uniform ignition of the solid fuel is accomplished by virtue of the fact that a "cone" is created by the cone forming means 82, i.e., by the splitter plates 84 and 86, which is operative to divide the primary air/solid fuel stream into two streams, i.e., the stream denoted by the arrow identified in FIG. 7 by the reference numeral 90 and the stream denoted by the pair of arrows, each identified in FIG. 7 by the reference numeral 92. Each of the streams 90 and 92 are capable of having a different velocity and momentum whereby the third embodiment of the MRFC solid fuel nozzle tip 12" can be made to have a wide range of velocity and momentum values as required for purposes of controlling at the exit end of the third embodiment of the MRFC solid fuel nozzle tip 12" the aerodynamics existing thereat, which in turn influence flame front position and flame characteristics. Generally speaking, the variables that have been used in determining the nature of the cone that is created through the use of the cone forming means 82, i.e., through the use of the splitter plates 84 and 86, are the inlet area of the cone created by the cone forming means 82 as compared to the inlet area of the third embodiment of the MRFC solid fuel nozzle tip 12" and the exit area of the cone created by the cone forming means 82 as compared to the exit area of the third embodiment of the MRFC solid fuel nozzle tip 12". Moreover, if so desired without departing from the essence of the present invention, the cone created by the cone forming means 82 could be made to include mechanisms for imparting swirl to the primary air stream, the secondary air stream or both, and for controlling mixing between the primary air stream and the secondary air stream.

Figure 9:
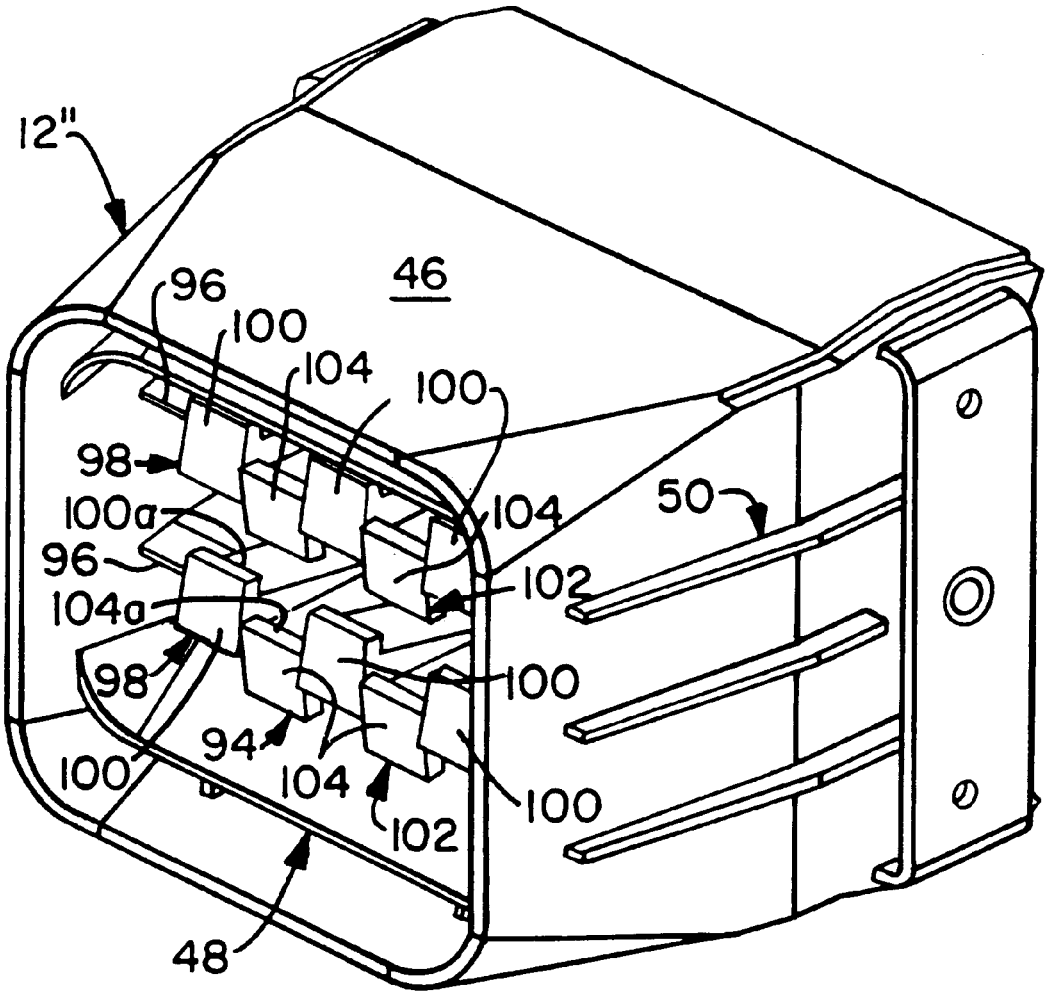
FIG. 9 is a perspective view of a pulverized solid fuel nozzle, which is illustrated in FIG. 9 embodying a fourth embodiment of a minimum recirculation flame control (MRFC) solid fuel nozzle tip constructed in accordance with the present invention, of the type employed in the firing system of the pulverized solid fuel-fired furnace illustrated in FIG. 1.

A description will now be had herein of the nature of the construction and the mode of operation of the fourth embodiment of the MRFC solid fuel nozzle tip, which for purposes of differentiation from the first embodiment of the MRFC solid fuel nozzle tip 12, the second embodiment of the MRFC solid fuel nozzle tip 12' and the third embodiment of the MRFC solid fuel nozzle tip 12" is denoted generally in FIG. 9 by the reference numeral 12'". For purposes of the discussion of the fourth embodiment that follows those components of the fourth embodiment of the MRFC solid fuel nozzle tip 12'", which are common to the fourth embodiment of the MRFC solid fuel nozzle tip 12'" as well as to the third embodiment of the MRFC solid fuel nozzle tip 12", the second embodiment of the MRFC solid fuel nozzle tip 12' and the first embodiment of the MRFC solid fuel nozzle tip 12 are identified in FIG. 9 of the drawing by the same reference numerals that have been employed to identify these components in connection with the illustration of these components in FIGS. 3 and 4 of the drawing, in connection with the illustration of these components in FIGS. 5 and 6 of the drawing and in connection with the illustration of these components in FIGS. 7 and 8 of the drawing.

Continuing, the fourth embodiment of the MRFC solid fuel nozzle tip 12'" is characterized by the inclusion within the nozzle tip 12'" of low $NO_X$ reduction means, denoted generally in FIG. 9 of the drawing by the reference numeral 94. In accordance with the best mode embodiment of the nozzle tip 12'", the low $NO_X$ reduction means 94 comprises a modified version of the splitter plate means 52. More specifically, as best understood with reference to FIG. 9 of the drawing the low $NO_X$ reduction means 94 includes a plurality of splitter plates, each identified for ease of reference thereto by the same reference numeral 96 in FIG. 9 of the drawing. Cooperatively associated with each of the plurality of splitter plates 96 is a first set, denoted generally in FIG. 9 by the reference numeral 98, of wedge-shaped bluff bodies, each designated in FIG. 9 by the same reference numeral 100, and a second set, denoted generally in FIG. 9 by the reference numeral 102, of wedge-shaped bluff bodies, each designated in FIG. 9 by the same reference numeral 104.

As will be understood with reference to FIG. 9 of the drawing, the first set 98 of wedge-shaped bluff bodies 100 is cooperatively associated with each of the plurality of splitter plates 96 so as to project, as viewed with reference to FIG. 9, upwardly relative to a respective one of the plurality of splitter plates 96, i.e., so as to project above the centerline of the respective one of the plurality of splitter plates 96. Whereas, the second set 102 of wedge-shaped bluff bodies 104 is cooperatively associated with each of the plurality of splitter plates 96 so as to project, as viewed with reference to FIG. 9, downwardly relative to a respective one of the plurality of splitter plates 96, i.e., so as to project below the centerline of the respective one of the splitter plates 96.

In accordance with the best mode embodiment of the MRFC solid fuel nozzle tip 12''' and as will be best understood with reference to FIG. 9 of the drawing, the bluff bodies 100 as well as the bluff bodies 104 are each withdrawn 0.5 to 2.0 inches from both the primary air shroud means 48, which surrounds the solid fuel stream, and the exit plane of the MRFC solid fuel nozzle tip 12''' such that the high turbulence region of the solid fuel stream is encased within a low turbulence solid fuel "blanket". Furthermore, the bluff bodies 100 as well as the bluff bodies 104 each embody, as can be seen with reference to FIG. 9, essentially a wedge-shaped configuration with offset appendages, denoted in the case of the bluff bodies 100 each by the reference numeral 100*a* and denoted in the case of the bluff bodies 104 each by the reference numeral 104*a*. The bluff bodies 100 with offset appendages 100*a* and the bluff bodies 104 with offset appendages 104*a* bear a resemblance in appearance to so-called "pumpkin teeth", i.e., the teeth carved into a pumpkin for Halloween.

The effect of the bluff bodies 100 with offset appendages 100*a* and the bluff bodies 104 with offset appendages 104*a* is to maximize turbulence and vortex shedding while yet maintaining the ability of the MRFC solid fuel nozzle tip 12''' to tilt and to direct the solid fuel stream. In accordance with the best mode embodiment of the MRFC solid fuel nozzle tip 12''', the offset appendages 100*a* and the offset appendages 104*a* are each approximately 0.75 to 1.75 inches wide, and are each offset vertically 0.5 to 2.5 inches from each of the offset appendages 100*a* or offset appendages 104*a* that is adjacent thereto.

Referring again to FIG. 9 to the drawing, as will be best understood with reference thereto the offset appendages 100*a* and the offset appendages 104*a* are each located at the trailing end of the respective one of the plurality of splitter plates 96, with which the bluff bodies 100 and the bluff bodies 104 are respectively cooperatively associated. Note is further made here of the fact that in accordance with the best mode embodiment of the MRFC solid fuel nozzle tip 12''' each of the plurality of splitter plates 96 is 2 to 5 inches shorter in length than the length of the MRFC solid fuel nozzle tip 12'''.

By virtue of the geometry, which has been described hereinabove, embodied thereby, the low $NO_X$ reduction means 94 is operative to maximize the overall effect of the vortices, which are created, because of the fact that the vortices are not located so close to each other that adjacent vortices cancel one another. Yet the geometry, of the low $NO_X$ reduction means 94 still enables a maximum number of vortex generating locations to be provided. Therefore, it is possible to produce with the reduction means 94 a flame front, which typically over a range of solid fuel types is located 6 inches to 2 feet from the exit plane of the MRFC solid fuel nozzle tip 12'''. To thus summarize, the design of the low $NO_X$ reduction means 94 in terms of the number, geometry, size, overlap and location of the bluff bodies 100 and bluff bodies 104 is effective in optimizing the number of "trip points", which are operative to effect the dispersion of the solid fuel jet, i.e., stream, while yet maintaining each of the "trip points" as an individually distinct location. The result is that there is thus provided a solid fuel nozzle tip, i.e., the MRFC solid fuel nozzle tip 12''', which insofar as the performance of the nozzle tip 12'' is concerned combines low $NO_X$ emissions and low carbon in the flyash with minimal deposition, which in turn results in long service life for the MRFC solid fuel nozzle tip 12'''.

Thus, in accordance with the present invention there has been provided a new and improved solid fuel nozzle tip for use in a firing system of the type utilized in pulverized solid fuel-fired furnaces. Besides, there has been provided in accord with the present invention such a new and improved solid fuel nozzle tip for use in a firing system of the type utilized in a pulverized solid fuel-fired furnace that is operative as a minimum recirculation flame control (MRFC) solid fuel nozzle tip. As well, in accordance with the present invention there has been provided such a new and improved MRFC solid fuel nozzle tip for use in a firing system of the type utilized in a pulverized solid fuel-fired furnace that is characterized in that the primary shroud is recessed. Moreover, there has been provided in accord with the present invention such a new and improved MRFC solid fuel nozzle tip for use in a firing system of the type utilized in a pulverized solid fuel-fired furnace that is characterized in that the splitter plates are recessed. Also, in accordance with the present invention there has been provided such a new and improved MRFC solid fuel nozzle tip for use in a firing system of the type utilized in a pulverized solid fuel-fired furnace that is characterized in that the secondary air shroud support ribs are recessed. Further, there has been provided in accord with the present invention such a new and improved MRFC solid fuel nozzle tip for use in a firing system of the type utilized in a pulverized solid fuel-fired furnace that is characterized in that the trailing edge of the primary air shroud is tapered. In addition, in accordance with the present invention there has been provided such a new and improved MRFC solid fuel nozzle tip for use in a firing system of the type utilized in a pulverized solid fuel-fired furnace that is characterized in that the ends of the splitter plates are tapered. Furthermore, there has been provided in accord with the present invention such a new and improved MRFC solid fuel nozzle tip for use in a firing system of the type utilized in a pulverized solid fuel-fired furnace that is characterized in that the secondary air shroud embodies a bulbous inlet. Additionally, in accordance with the present invention there has been provided such a new and improved MRFC solid fuel nozzle tip for use in a firing system of the type utilized in a pulverized solid fuel-fired furnace that is characterized in that the exit plane corners of the primary air shroud are rounded. Besides, there has been provided in accord with the present invention such a new and improved MRFC solid fuel nozzle tip for use in a firing system of the type utilized in a pulverized solid fuel-fired furnace that is characterized in that the exit plane corners of the secondary air shroud are rounded. Penultimately, in accordance with the present invention there has been provided such a new and improved MRFC solid fuel nozzle tip for use in a firing system of the type utilized in a pulverized solid fuel-fired furnace that is characterized in that the secondary air shroud is provided with a uniform opening. Finally, there has been provided in accord with the present invention such a new and improved MRFC solid fuel nozzle tip for use in a firing system of the type utilized in a pulverized solid fuel-fired furnace that is characterized in that for purposes of attaining therewith minimum $NO_X$ emissions and/or minimum carbon in the flyash one or more bluff bodies, each embodying a predefined geometry, are suitably supported at a predetermined location within the nozzle tip.

While several embodiments of our invention have been shown, it will be appreciated that modifications thereof, some of which have been alluded to hereinabove, may still be readily made thereto by those skilled in the art. We, therefore, intend by the appended claims to cover the modifications alluded to herein as well as all the other modifications which fall within the true spirit and scope of our invention.

What is claimed is:

1. A minimum recirculation flame control solid fuel nozzle tip for use in cooperative association with a pulverized solid fuel nozzle of a firing system of a pulverized solid fuel-fired furnace:

a. a secondary air shroud mountable in supported relation to and at one end of the pulverized solid fuel nozzle, said secondary air shroud having an inlet end and an outlet end, said secondary air shroud including a bulbous configuration at the inlet end of the secondary air shroud, said bulbous configuration being operative to minimize any bypassing of secondary air around said secondary air shroud when said secondary air shroud is in a tilted condition and and also being operative to enhance a cooling effect produced by the flow of secondary air through said secondary air shroud, said secondary air shroud also including rounded corners, said rounded corners being operative to produce higher velocities in said rounded corners of said secondary air shroud to thereby minimize low velocity regions on said secondary air shroud whereat solid fuel deposition could occur;

b. a primary air shroud mounted in supported relation within said secondary air shroud, said primary air shroud including a leading edge and a trailing edge, said trailing edge of said primary air shroud being recessed from said outlet end by an amount sufficient to remove said trailing edge of said primary air shroud as a potential surface for solid fuel particles, said primary air shroud also including rounded corners, said rounded corners of said primary air shroud being operative to increase velocities in said rounded corners of said primary air shroud thereby assisting in helping to avoid deposition of solid fuel particles at the rounded corners of the primary air shroud and if such deposition does occur assisting in effecting removal of such solid fuel particles;

c. a secondary air shroud support interposed between said secondary air shroud and said primary air shroud so as to be operative for effectuating support of said secondary air shroud relative to said primary air shroud, said secondary air shroud support being recessed from said trailing edge of said primary air shroud by an amount sufficient to keep a recirculation region and vertical deposition surface created by said secondary air shroud support away from said outlet end of said secondary air shroud so as to thereby reduce influence of said secondary air shroud support on the deposition and also sufficient to allow said outlet end of said secondary air shroud and said trailing edge of said primary air shroud to independently expand relative to one another thereby reducing thermally induces stress in the secondary air shroud and the primary air shroud; and d. a splitter plate supported in mounted relation to and within said primary air shroud, said splitter plate being recessed from said outlet end of said secondary air shroud by an amount sufficient to remove said splitter plate as a site susceptible to potential deposition of solid fuel particles and sufficient to provide some cooling of said splitter plate by virtue of shielding provided to the splitter plate by said secondary air shroud.

2. The minimum recirculation flame control solid fuel nozzle tip as set forth in claim 1 wherein said trailing edge of said primary air shroud is tapered in order to reduce the recirculation region at said trailing edge of said primary air shroud that might otherwise be operable to draw hot particulate matter back to said trailing edge of said primary air shroud and thereby exacerbate solid fuel particle deposition at the trailing edge of the primary air shroud.

3. The minimum recirculation flame control solid fuel nozzle tip as set forth in claim 1 wherein said splitter plate includes a trailing edge and a leading edge, said trailing edge of said splitter plate being tapered at a small enough angle to avoid separation of air flowing over said splitter plate while yet remaining operative to reduce the recirculation region at said trailing edge of said splitter plate in order to thereby minimize the possibility of solid fuel deposition occurring at the trailing edge of the splitter plate.

4. The minimum recirculation flame control solid fuel nozzle tip as set forth in claim 3 wherein said leading edge of said splitter plate is tapered at an angle so as to avoid separation of air flowing over said splitter plate while yet remaining operative to reduce the recirculation region at said leading edge of said splitter plate in order to thereby minimize the possibility of solid fuel deposition occurring at the leading edge of the splitter plate.

5. The minimum recirculation flame control solid fuel nozzle tip as set forth in claim 1 wherein said secondary air shroud is uniformly spaced from said primary air shroud so as to thereby provide a uniform opening at said outlet end of said secondary air shroud and uniform secondary air distribution within the minimum recirculation flame control solid fuel nozzle tip.

6. The minimum recirculation flame control solid fuel nozzle tip as set forth in claim 1 further comprising shielding configuration interposed between said outlet end of said secondary air shroud means and said trailing edge of said primary air shroud so as to effectuate a cooling of said primary air shroud.

7. The minimum recirculation flame control solid fuel nozzle tip as set forth in claim 6 wherein said shielding configuration comprises an off-set deflector member operative to shield said trailing edge of said primary air shroud from heat that would otherwise be radiated to the primary air shroud from said secondary air shroud, said off-set deflector member further being operative to direct a portion of the secondary air flowing through said secondary air shroud in a converging manner towards said trailing edge of said primary air shroud.

8. The minimum recirculation flame control solid fuel nozzle tip as set forth in claim 6 wherein said shielding configuration comprises a converging/diverging deflector member operative to shield said trailing edge of said primary air shroud from heat that would otherwise be radiated to the primary air shroud from said secondary air shroud, said converging/diverging deflector member further being operative to direct a first portion of the secondary air flowing through said secondary air shroud in a converging manner towards said trailing edge of said primary air shroud and a second portion of the secondary air flowing through said secondary air shroud in a diverging manner away from said trailing edge of said primary air shroud.

9. The minimum recirculation flame control solid fuel nozzle tip as set forth in claim 1 wherein said splitter plate comprises a cone forming configuration operative for effecting control over flame front positioning without the creation of recirculation regions at said outlet end of said secondary air shroud and without the creation of surface features that would be susceptible to deposition of solid fuel particles on the secondary air shroud.

10. The minimum recirculation flame control solid fuel nozzle tip as set forth in claim 9 wherein said cone forming configuration includes a pair of splitter plates mounted in spaced relation one to another in supported relation within said primary air shroud, said pair of splitter plates being operative to divide the primary air/solid fuel stream flowing through said primary air shroud into two streams each capable of having a different velocity and momentum for the purpose of controlling the aerodynamics that exist at said outlet end of said secondary air shroud.

11. The minimum recirculation flame control solid fuel nozzle tip as set forth in claim 1 wherein said splitter plate comprises $NO_X$ reduction configuration operative for minimizing $NO_X$ emissions and for minimizing carbon in flyash.

12. The minimum recirculation flame control solid fuel nozzle tip as set forth in claim 11 wherein said $NO_X$ reduction configuration includes a plurality of splitter plates mounted in spaced relation one to another in supported relation within said primary air shroud, and a first set of bluff bodies cooperatively associated with said plurality of splitter plates.

13. The minimum recirculation flame control solid fuel nozzle tip as set forth in claim 12 wherein said first set of bluff bodies is located at the trailing end of said plurality of splitter plates and so that each of the bluff bodies of said first set of bluff bodies projects upwardly relative to the centerline of said plurality of splitter plates.

14. The minimum recirculation flame control solid fuel nozzle tip as set forth in claim 13 wherein each of the bluff bodies of said first set of bluff bodies embodies an offset appendage.

15. The minimum recirculation flame control solid fuel nozzle tip as set forth in claim 12 wherein said $NO_X$ reduction configuration further includes a second set of bluff bodies cooperatively associated with said plurality of splitter plates.

16. The minimum recirculation flame control solid fuel nozzle tip as set forth in claim 15 wherein said second set of bluff bodies is located at the trailing end of said plurality of splitter plates and so that each of the bluff bodies of said second set of bluff bodies projects downwardly relative to the centerline of said plurality of splitter plates.

17. The minimum recirculation flame control solid fuel nozzle tip as set forth in claim 15 wherein each of the bluff bodies of said second set of bluff bodies embodies an offset appendage.

* * * * *